US010280584B2

(12) United States Patent
Nicol et al.

(10) Patent No.: US 10,280,584 B2
(45) Date of Patent: May 7, 2019

(54) REVERSIBLE SEGMENTAL RETAINING WALL BLOCK, MOLDS AND METHODS FOR MANUFACTURING SAME, AND METHODS OF FORMING RETAINING WALLS WITH SAME

(71) Applicant: RISI STONE, INC., Newmarket (CA)

(72) Inventors: Brock Nicol, Newmarket (CA); Tyler Matys, Newmarket (CA)

(73) Assignee: RISI STONE, INC., Ontario (CA)

( * ) Notice: Subject to any disclaimer, the term of this patent is extended or adjusted under 35 U.S.C. 154(b) by 0 days.

(21) Appl. No.: 15/954,825

(22) Filed: Apr. 17, 2018

(65) Prior Publication Data

US 2019/0100894 A1 Apr. 4, 2019

Related U.S. Application Data

(60) Provisional application No. 62/567,503, filed on Oct. 3, 2017.

(30) Foreign Application Priority Data

Apr. 3, 2018 (CA) ..... 3000082

(51) Int. Cl.
*E02D 29/02* (2006.01)

(52) U.S. Cl.
CPC ..... *E02D 29/0266* (2013.01); *E02D 29/025* (2013.01); *E02D 2250/0007* (2013.01); *E02D 2250/0023* (2013.01); *E02D 2300/002* (2013.01)

(58) Field of Classification Search
CPC ..... E04C 1/00; E04C 1/24; E02D 29/0266; E02D 29/025; E04B 2/18;
(Continued)

(56) References Cited

U.S. PATENT DOCUMENTS 4,051,642 A * 10/1977 Terry ..... E02D 27/00 52/263
5,622,456 A * 4/1997 Risi ..... E02D 29/025 405/262

(Continued)

FOREIGN PATENT DOCUMENTS

DE 3236739 A1 4/1984
DE 10037716 A1 2/2002

(Continued)

OTHER PUBLICATIONS

Communication dated Jan. 30, 2019, from European Patent Office in counterpart application No. 18198394.1.

*Primary Examiner* — Sean D Andrish
(74) *Attorney, Agent, or Firm* — Sughrue Mion, PLLC

(57) ABSTRACT

A retaining wall block includes a block body comprising a top side and a bottom side opposite the top side; a front side and a rear side opposite the rear side; a right side and a left side opposite the right side. A lateral interlock system includes a first lateral interlock interface that is integral with the right side and a second lateral interlock interface that is integral with the left side, each of the first and second lateral interlock interfaces including: a male-type lateral interface component and three female-type lateral interface components, each of the lateral interface components being in vertical alignment with one of the other lateral interface components and in horizontal alignment with still another of the lateral interface components, wherein the first lateral interlock interface and the second lateral interlock interface are, when viewed in elevation, identical.

16 Claims, 35 Drawing Sheets

(58) Field of Classification Search
CPC ..... E04B 2002/0215; E04B 2/08; E04B 2002/0226; E02B 3/14
USPC ..... 405/284, 286; 52/592.1, 592.2, 592.6, 52/604
See application file for complete search history.

(56) References Cited

U.S. PATENT DOCUMENTS

| | | | | |
|---|---|---|---|---|
| 5,823,717 | A * | 10/1998 | Bastick | E02D 29/02 405/286 |
| 6,234,721 | B1 | 5/2001 | Cronkhite et al. | |
| 6,863,469 | B2 * | 3/2005 | Bolduc | E01C 5/06 404/34 |
| 9,453,341 | B1 | 9/2016 | Swierad et al. | |
| 2006/0059824 | A1 | 3/2006 | Barbisch | |
| 2012/0057939 | A1 | 3/2012 | Bone | |
| 2013/0034392 | A1 * | 2/2013 | Ferraiolo | E02D 29/0241 405/284 |

FOREIGN PATENT DOCUMENTS

| | | | |
|---|---|---|---|
| EP | 0282679 | A1 | 9/1988 |
| EP | 616091 | * | 9/1994 |

* cited by examiner

REVERSIBLE SEGMENTAL RETAINING WALL BLOCK, MOLDS AND METHODS FOR MANUFACTURING SAME, AND METHODS OF FORMING RETAINING WALLS WITH SAME

CROSS-REFERENCE TO RELATED APPLICATION

This application claims priority to U.S. Provisional Patent Application Ser. No. 62/567,503 filed on Oct. 3, 2017, the contents of which are incorporated herein by reference in their entirety.

FIELD OF THE INVENTION

The present disclosure relates generally to prefabricated interlocking concrete blocks, and more particularly to reversible segmental retaining wall blocks, molds and methods for manufacturing reversible segmental retaining wall blocks, and methods of forming retaining walls with same.

BACKGROUND OF THE INVENTION

Interlocking concrete blocks are used for many outdoor construction applications, one of the most common being the construction of retaining walls. Interlocking concrete blocks are thus designed for durability, stability, and aesthetic appeal.

Current methods of manufacturing dry-cast concrete blocks allow the producer to create different face textures and appearances on the block. The common "split-face" appearance is produced for example by forming the concrete blocks and then splitting them after curing to form faces having rough, rock-like appearances. The process is shown in further detail FIGS. 1 through 8, where FIG. 1 is an isometric view of a prior art mold box 10 and draw plate 12 used to form dry cast blocks face to face. FIG. 2 is an isometric view of the prior art mold box 10 and pull draw plate 12 of FIG. 1, with dry mix concrete for blocks 16 having been fed into the mold box 10 from the top. FIG. 3 is an isometric view of the prior art mold box 10 containing dry mix concrete for blocks 16 as in FIG. 2 and to which a press head 18 is applying pressure and vibration thereby to compress the dry mix concrete for blocks 16 and to form the top surface of the blocks 16 (16*a*, 16*b*, 16*c* when separated) being formed. FIG. 4 is an isometric view of the press head 18 of FIG. 3 being withdrawn from the dry mix concrete for blocks 16 after having been applied. FIG. 5 is an isometric view of the draw plate 12 being withdrawn from underneath the compressed dry mix concrete pursuant to the application of the press head 18, revealing keys (grooves) and any chamfers C formed by the presence of the draw plate 12 and individual draw fingers 14. FIG. 6 is an isometric view of the mold box 10 being withdrawn from around the previously-compressed dry mix concrete for blocks 16. FIG. 7 is an isometric view of blades 20*a* and 20*b* contacting respective portions of the previously-compressed dry mix concrete for blocks 16 thereby to split the whole into multiple blocks 16*a*, 16*b*, and 16*c*. FIG. 8 is an isometric view of the multiple blocks 16*a*, 16*b*, 16*c* formed by the blades 20*a*, 20*b* of FIG. 7 and their "split face" rough and aesthetically-desirable appearance 17*a*, 17*b*, and 17*c*.

In alternative methods, such blocks are formed on their sides, or a specially-designed texture, such as a natural stone-like texture, can be "pressed" into the face of the blocks during the dry-cast process.

To provide vertical interlock between blocks, some type of shear key is formed into blocks, such as a respective tongue (top) and groove (bottom) or a rear lip, a lug, etc. Such a key/groove pair is shown in FIG. 8. The key/groove pair provides vertical shear resistance between the blocks as well as an aid in alignment of blocks with each other. Some alternative methods for achieving vertical interlock between successive courses involve using auxiliary plastic or fiberglass pins, clips, or connectors, added during construction of the wall. However, such auxiliary elements require an extra installation step, their application is subject to human error, and they increase costs.

Current design trends in architecture and landscape architecture are emphasizing clean, linear lines and smooth surfaces. Use of shadow and light to create a visually appealing fascia on buildings and walls is becoming a primary tool of many architectural designers. However, known blocks and methods of installation do not easily enable a builder to achieve the new modern appearance we desired in a retaining wall having protrusions producing highlights and shadows.

SUMMARY OF THE INVENTION

In accordance with an aspect, there is provided a retaining wall block comprising a block body comprising a top side and a bottom side opposite the top side; a front side and a rear side opposite the rear side; a right side and a left side opposite the right side; a lateral interlock system comprising a first lateral interlock interface that is integral with the right side and a second lateral interlock interface that is integral with the left side, each of the first and second lateral interlock interfaces comprising: a male-type lateral interface component and three female-type lateral interface components, each of the lateral interface components being in vertical alignment with one of the other lateral interface components and in horizontal alignment with still another of the lateral interface components, wherein the first lateral interlock interface and the second lateral interlock interface are, when viewed in elevation, identical.

In accordance with another aspect, there is provided molds and methods for manufacturing retaining wall blocks, and methods of forming retaining walls with same.

BRIEF DESCRIPTION OF THE FIGURES

Embodiments will now be described more fully with reference to the accompany drawings, in which.

DETAILED DESCRIPTION OF THE EMBODIMENTS

Figure 1:
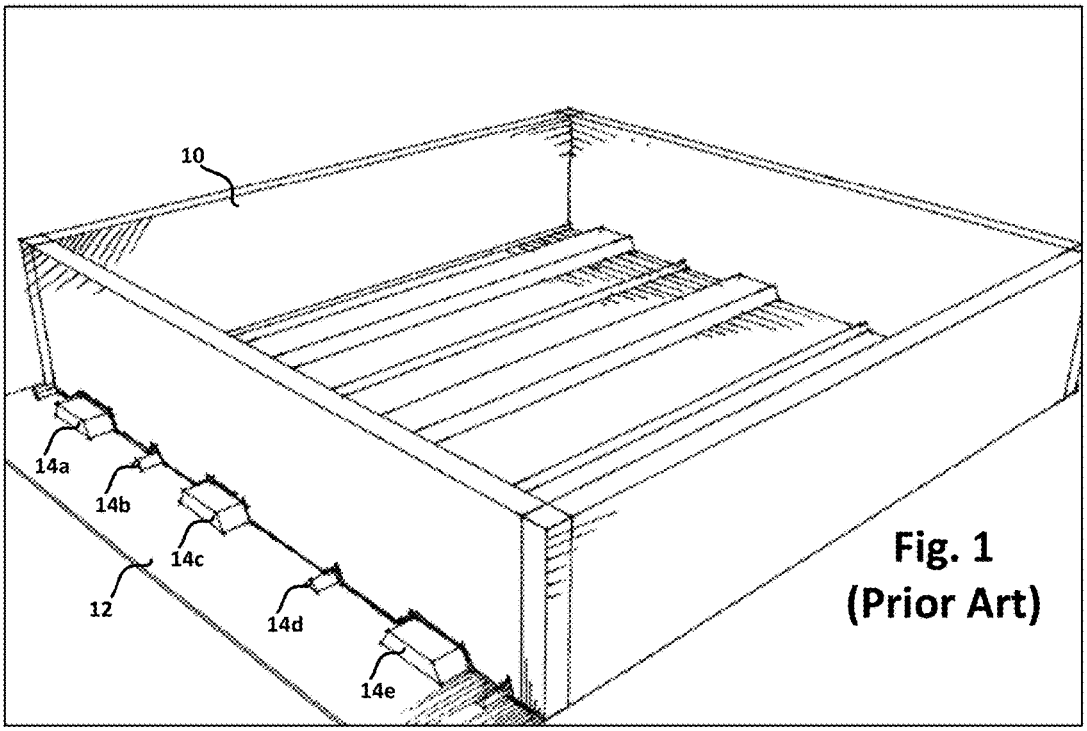
Fig. 1 (Prior Art)
FIG. 1 is an isometric view of a prior art mold box and pull draw plate used to form dry cast blocks face to face.
Figure 2:
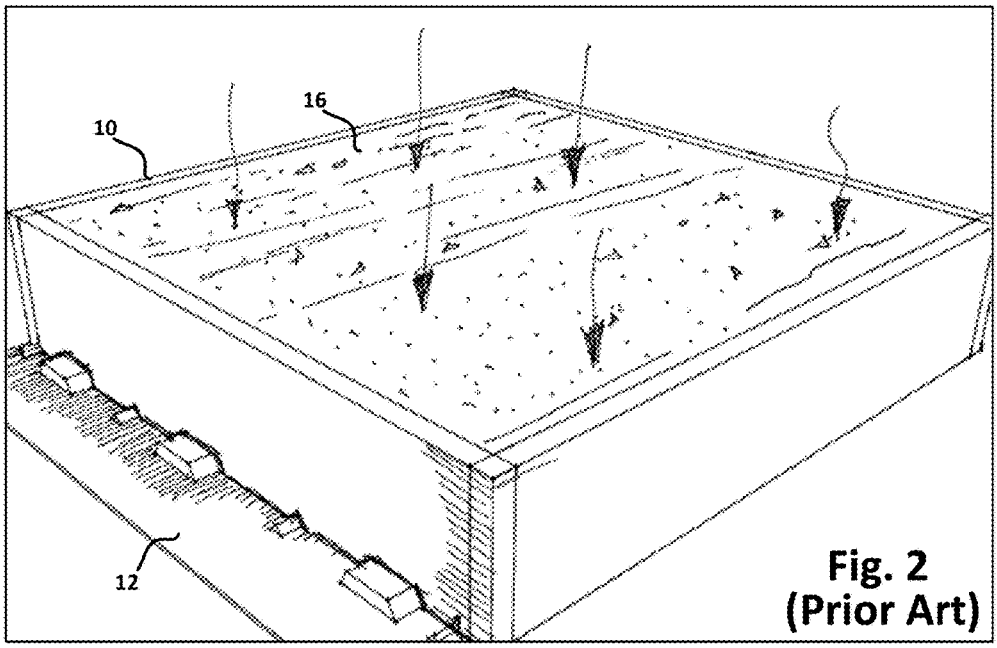
Fig. 2 (Prior Art)
FIG. 2 is an isometric view of the prior art mold box and pull draw plate of FIG. 1, with dry mix concrete having been fed into the mold box from the top.
Figure 3:
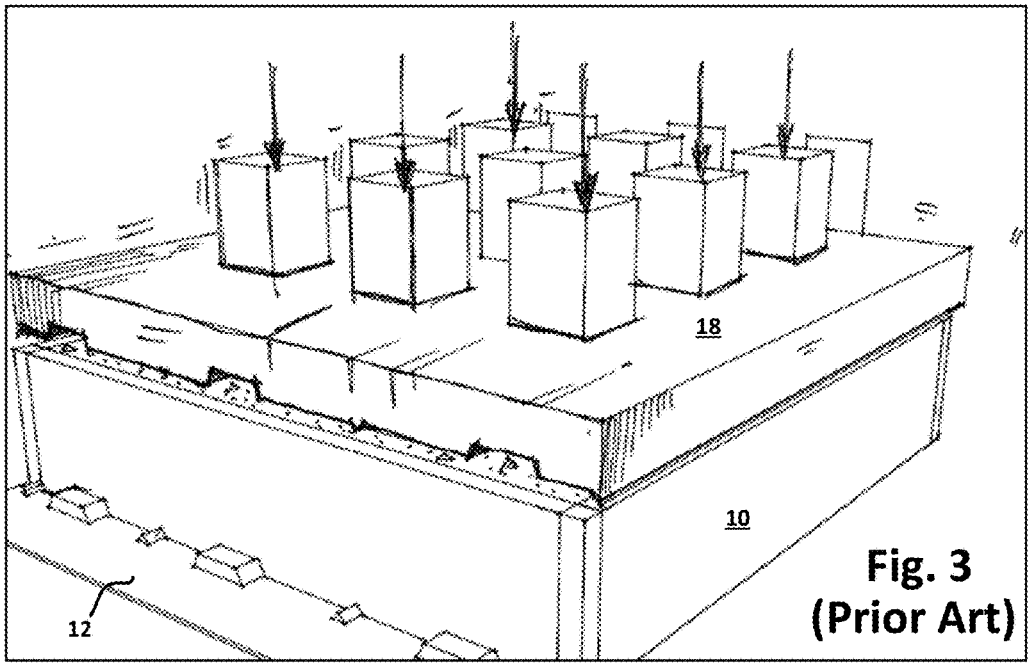
Fig. 3 (Prior Art)
FIG. 3 is an isometric view of the prior art mold box containing dry mix concrete as in FIG. 2 and to which a press head is applying pressure and vibration to the dry mix concrete thereby to compress the dry mix concrete and to form the top surface of the blocks being formed.
Figure 4:
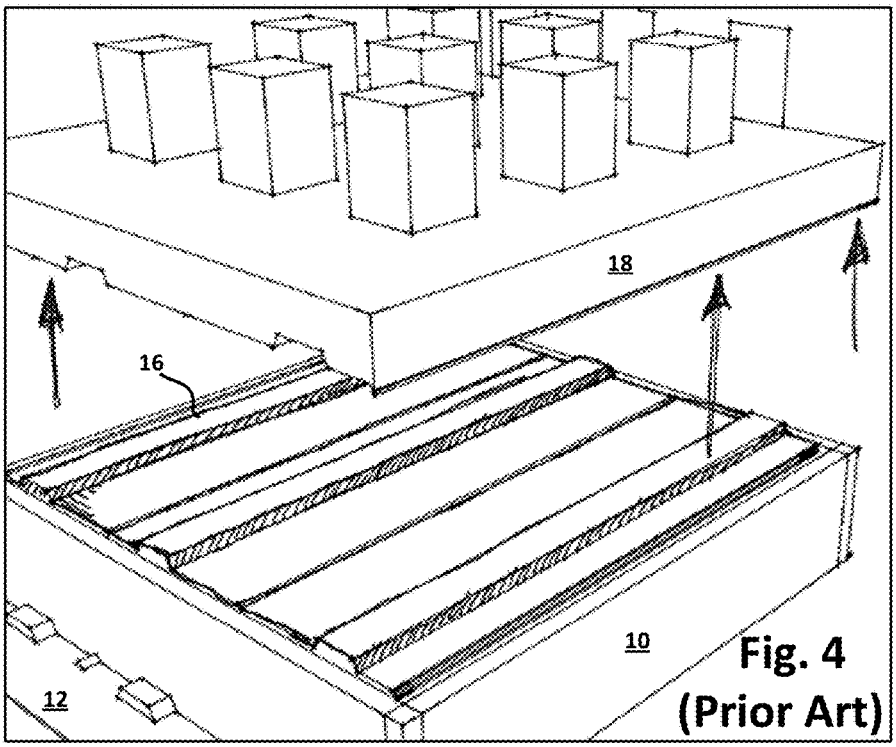
Fig. 4 (Prior Art)
FIG. 4 is an isometric view of the press head of FIG. 3 being withdrawn from the dry mix concrete after having been applied.
Figure 5:
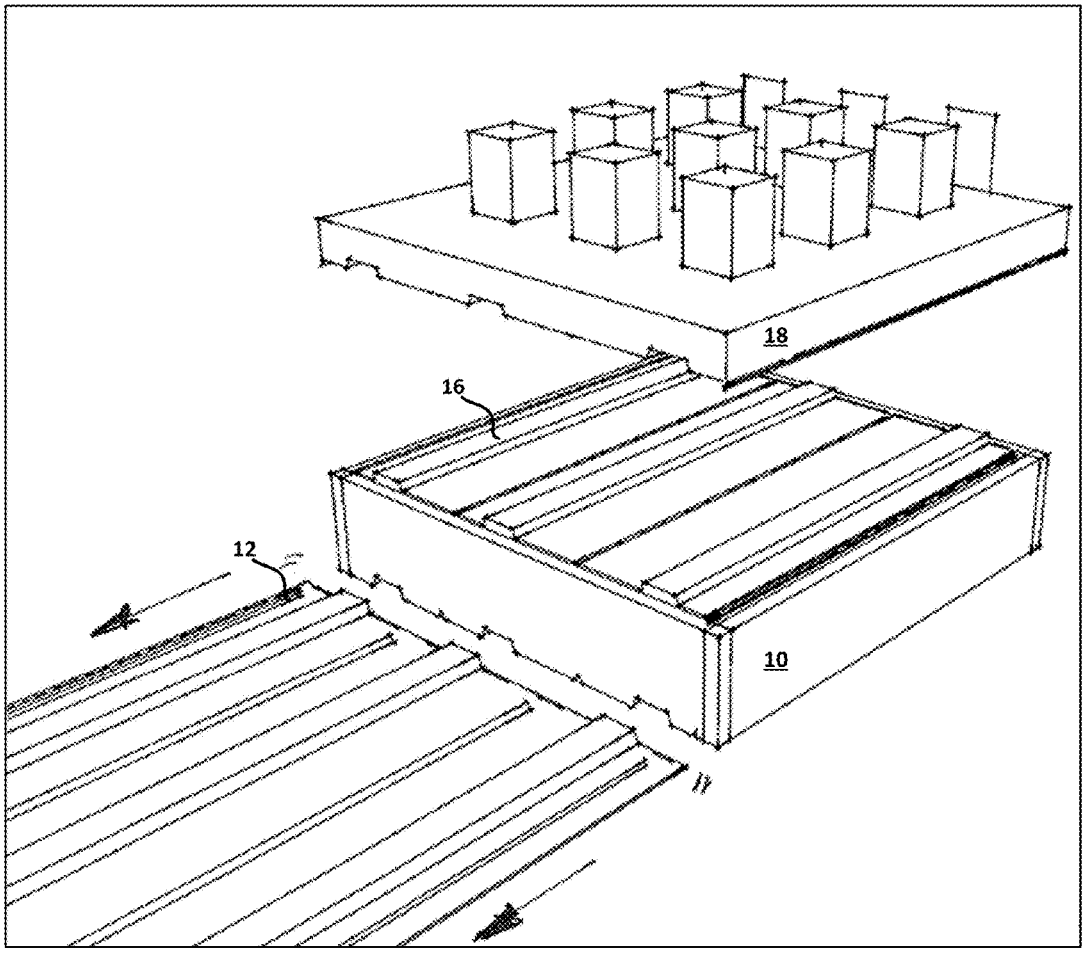
Fig. 5 (Prior Art)
FIG. 5 is an isometric view of the draw plate being withdrawn from underneath the compressed dry mix concrete pursuant to the application of the press head, revealing keys (grooves) and any chamfers formed by the presence of the draw plate.
Figure 6:
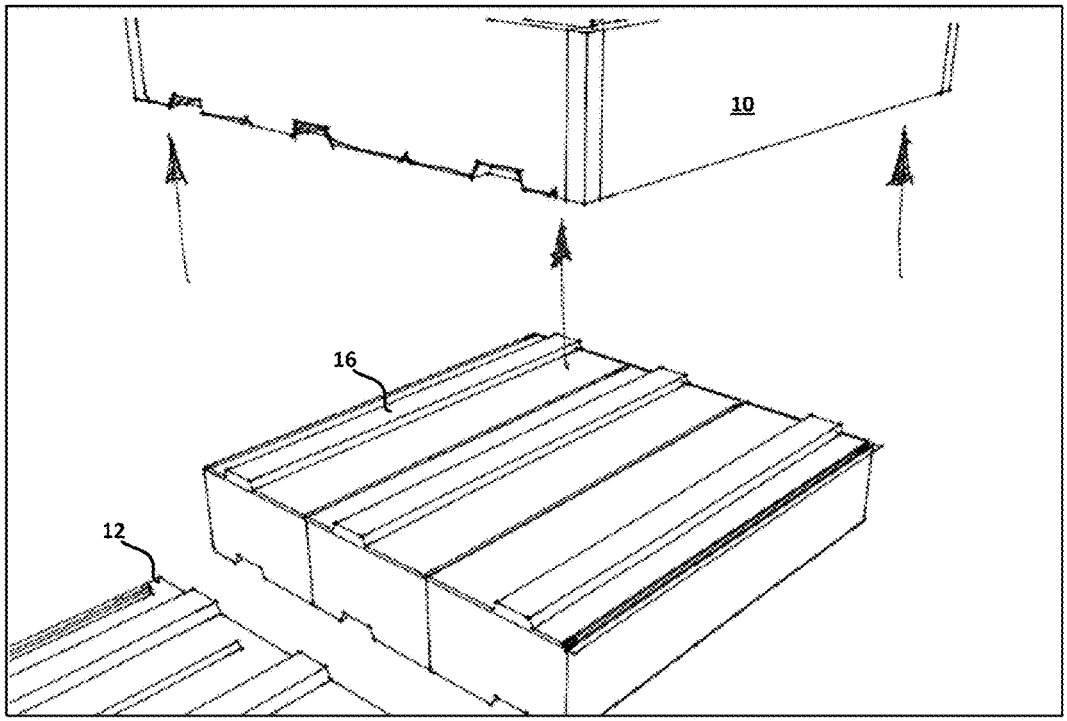
Fig. 6 (Prior Art)
FIG. 6 is an isometric view of the mold box being withdrawn from around the previously-compressed dry mix concrete.
Figure 7:
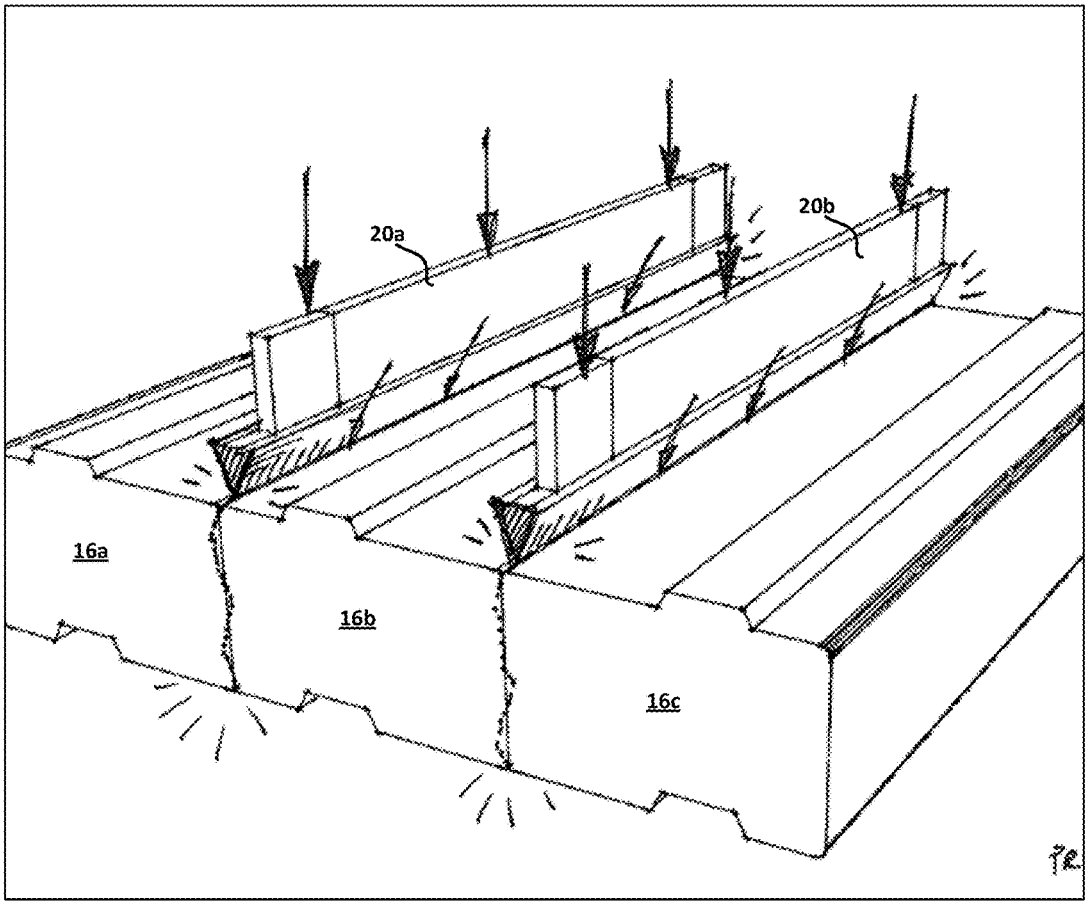
Fig. 7 (Prior Art)
FIG. 7 is an isometric view of blades contacting respective portions of the previously-compressed dry mix concrete thereby to split the whole into multiple blocks.
Figure 8:
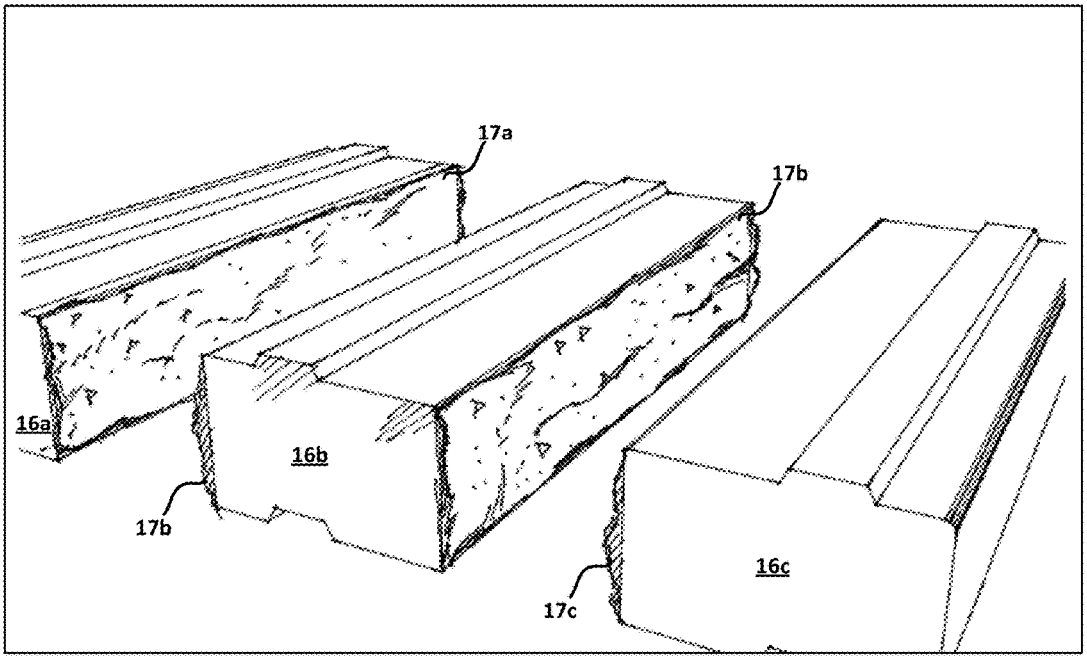
Fig. 8 (Prior Art)
FIG. 8 is an isometric view of the multiple blocks formed by the blades of FIG. 7 and their "split face" rough and aesthetically-desirable appearance.
Figure 9:
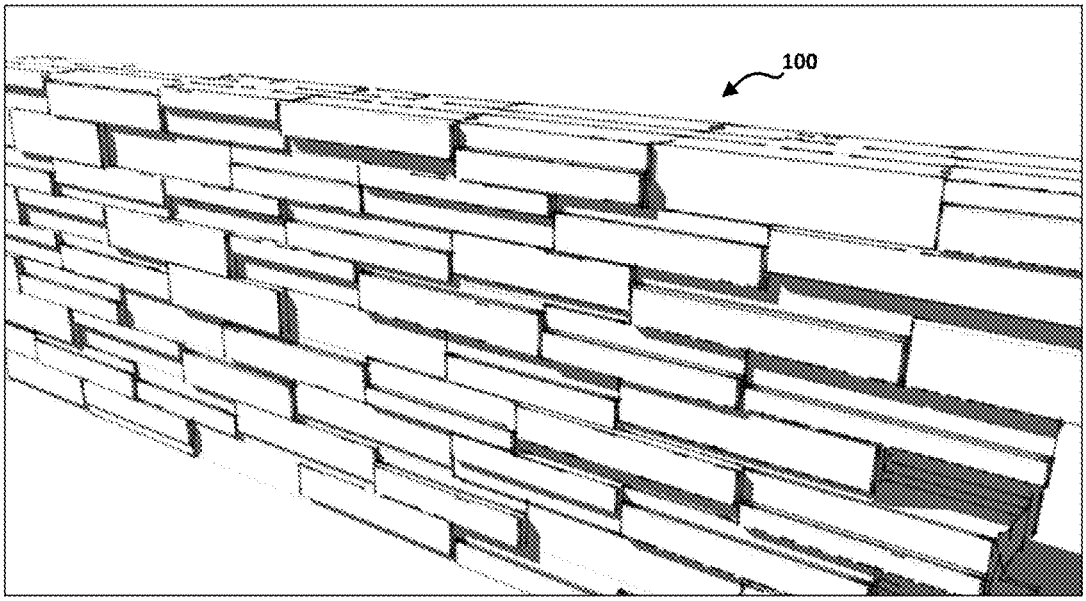
FIG. 9 is an isometric view of a portion of a retaining wall made of individual blocks having, respectively, a front face with a shelf ledge or a front face with an overhang ledge.
Figure 10:
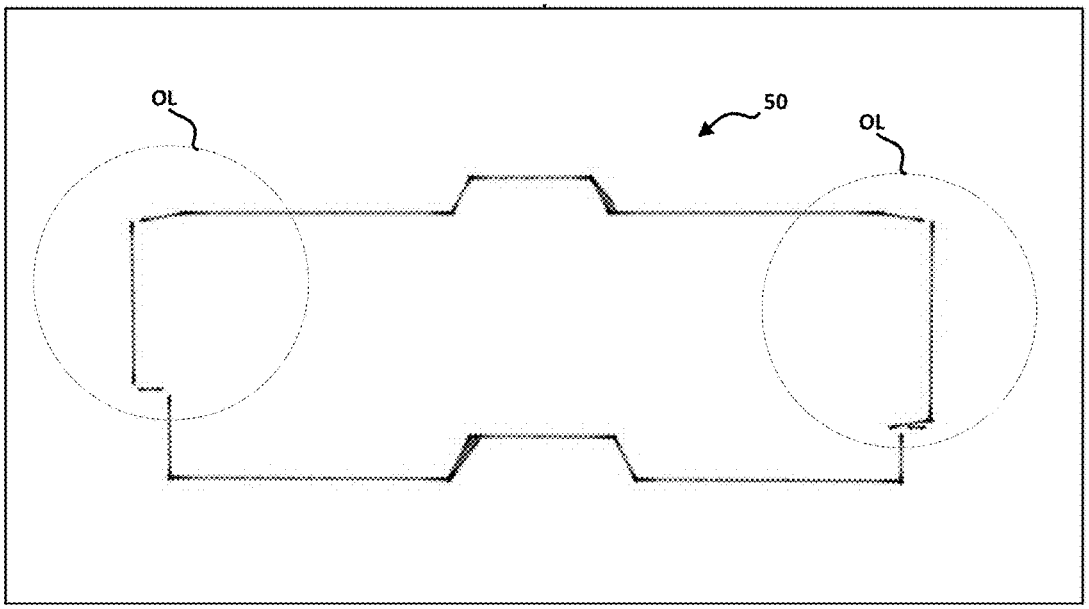
FIG. 10 is an elevational side view of a retaining wall block having an overhang ledge on its front face and an overhang ledge on its rear face.
Figure 11:
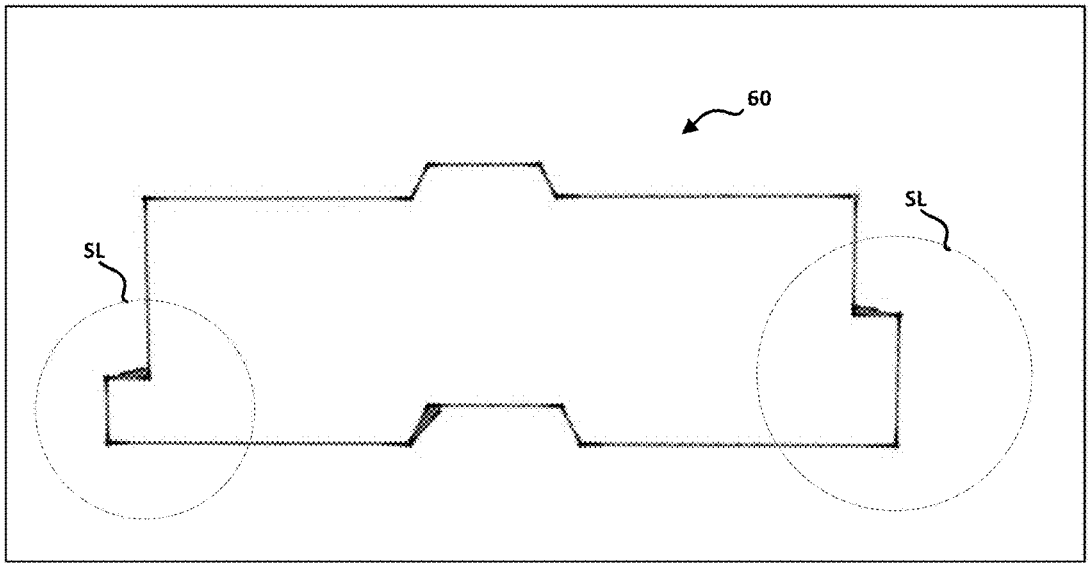
FIG. 11 is an elevational side view of a retaining wall block having a shelf ledge on its front face and a shelf ledge on its rear face.

An aesthetically desirable retaining wall design can be achieved by presenting thin ledges of varying depths, heights and orientations across outward-facing sides of the retaining wall to thereby produce corresponding contrasting shadows and highlights. FIG. 9 is an isometric view of a portion of such a retaining wall 100. Retaining wall 100 is made of individual retaining wall blocks having, respectively, a front face with a shelf ledge SL or a front face with an overhang ledge OL. For example, FIG. 10 is an elevational side view of a retaining wall block 50 having an overhang ledge OL of a respective depth and height on its front face 52 and an overhang ledge OL of a respective depth and height on its rear face 54. FIG. 11 is an elevational side view of a retaining wall block 60 having a shelf ledge SL of a respective depth and height on its front face 62 and a shelf ledge SL of a respective depth and height on its rear face 64. Blocks 50 and 60, having oppositely-oriented ledges (that is, overhang ledges OL and shelf ledges SL), as well as others like blocks, could be used by an installer to construct a wall such as wall 100. The overhang ledges OL, in conjunction with sunlight, cause the shadow regions while the shelf ledges SL permit the highlight regions.

Figure 12:
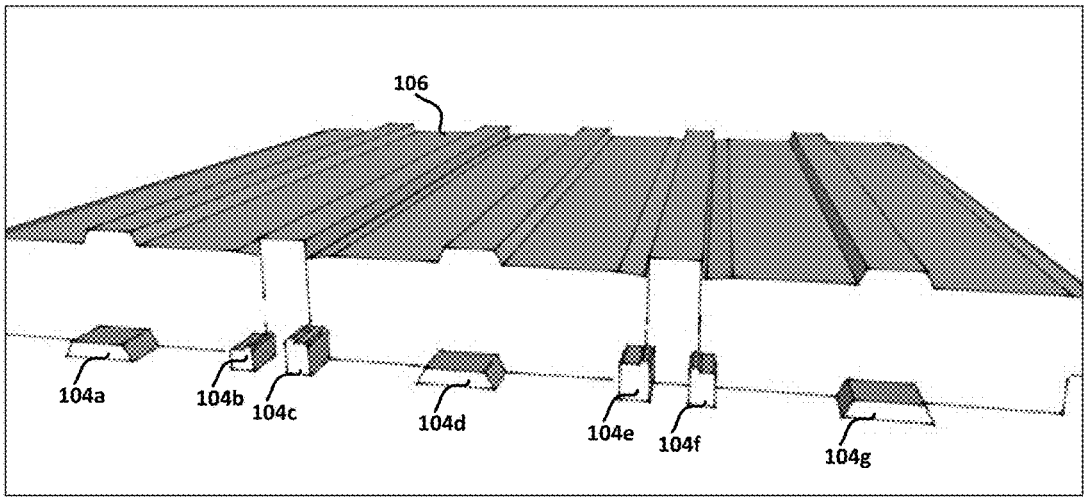
FIG. 12 is an isometric side view of draw fingers of different dimensions, over which dry mix concrete has been poured and pressed during molding (mold box not shown) thereby to form key channels in a bottom surface and overhang ledges on front and rear faces of individual blocks.
Figure 13:
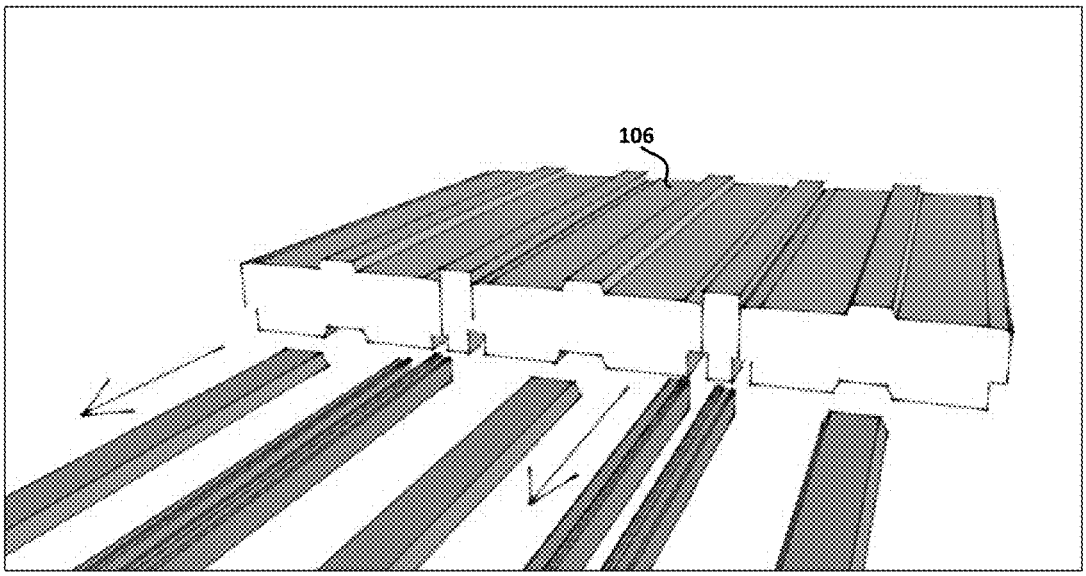
FIG. 13 is an isometric side view of the draw fingers having been withdrawn from underneath the pressed dry mix concrete of FIG. 12.
Figure 14:
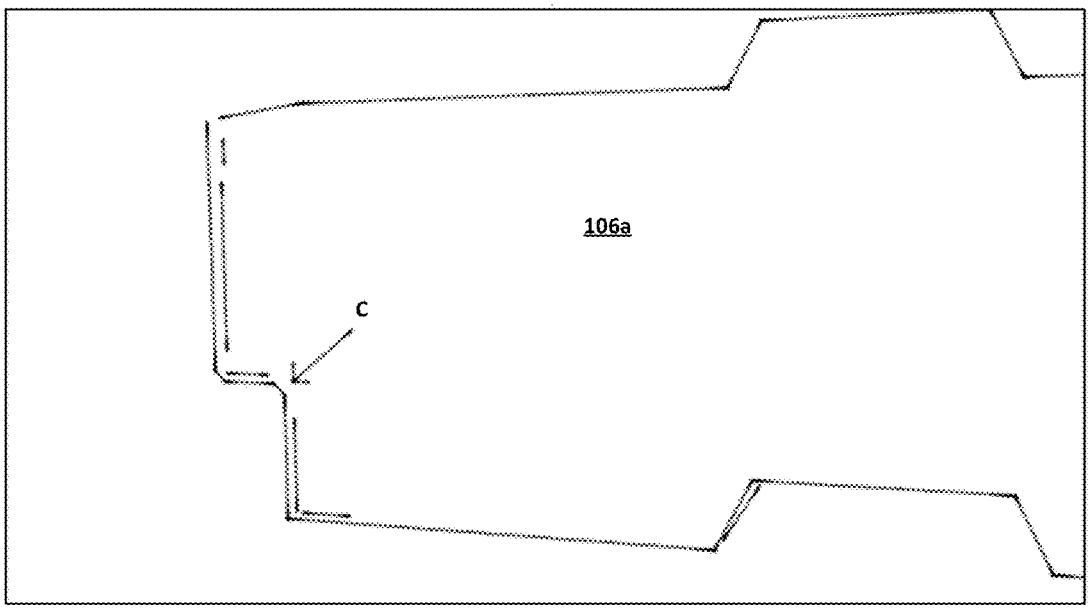
FIG. 14 is an elevational side view of a portion of a retaining wall block having an overhang ledge on its front face, with the overhang ledge being supported underneath by an integral chamfer.

According to an embodiment, overhang ledges are formed in dry mix concrete and accordingly in the resultant blocks using draw fingers. In an embodiment, as shown in FIG. 12, draw fingers 104*b*, 104*c*, 104*e*, and 104*f* are profiled to create various depths and height of the protrusion to be formed in blocks to be made of dry mix concrete 106, as shown in FIGS. 12 and 13. More particularly, the profiled draw fingers 104*a* to 104*g* are in place when the dry mix concrete 106 is fed into the mold box and compacted (not shown in FIGS. 12 and 13), and are then extracted quickly. The formed overhang ledges maintain their shape due to the low water content of the concrete and the compactive effort of the press head. In an embodiment, to promote stability of the overhang ledge while it is curing, a small chamfer C is also formed in each block, such as block 106*a*, to help support the overhanging portion, as shown in FIG. 14.

Figure 15:
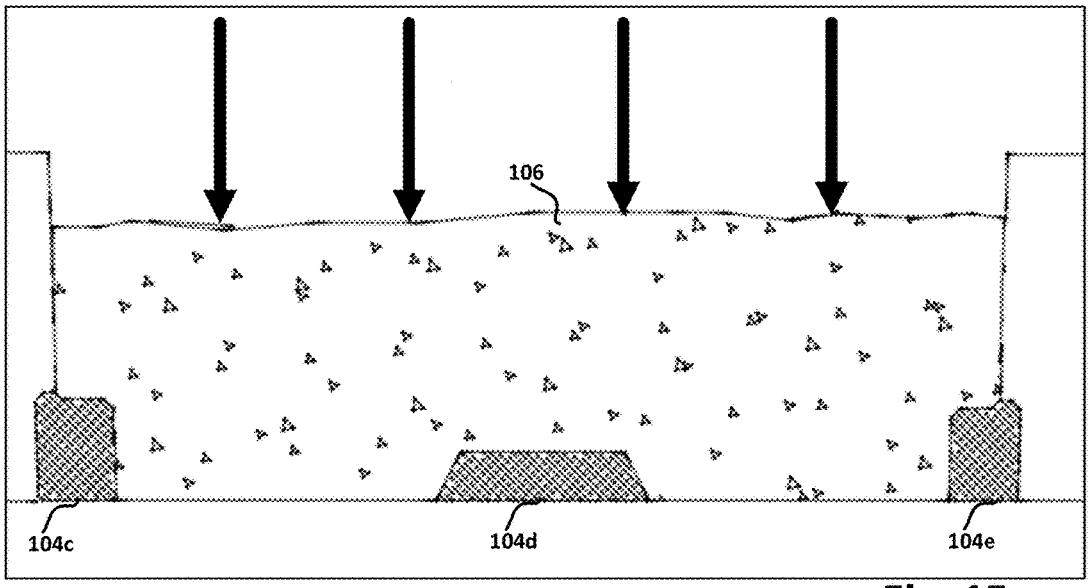
FIG. 15 is an elevational side view of the compression force onto dry mix concrete that has been poured atop draw fingers (mold box not shown) to form overhang ledges on front and rear faces of a retaining wall block being formed.

Formation of overhang ledges in this manner can be done with a high degree of quality, density, and finish. This is because each overhang ledge is located at the top of the mold, enabling feeding of the dry mix concrete directly into the corresponding cavity from above and direct compaction onto dry mix concrete 106 from above using a press head with no obstruction and atop draw fingers 104*c*, 104*d*, 104*e*, and 104*f* as shown in FIG. 15.

Figure 16:
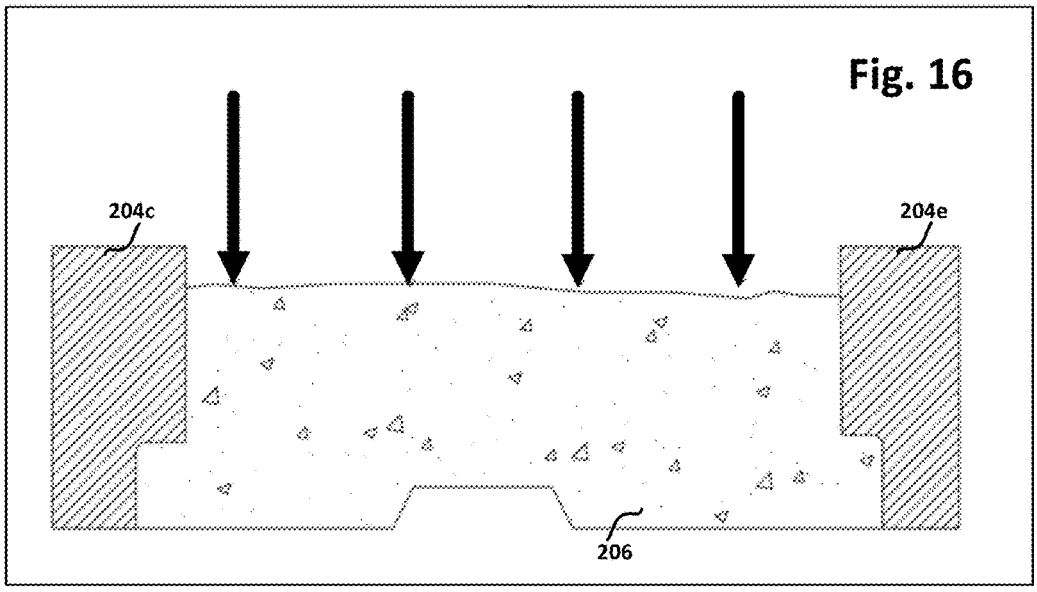
FIG. 16 is an elevational side view of the compression force onto dry mix concrete that has been poured into an area bounded by mold box sidewalls with recesses in the bottom portion to form shelf ledges on front and rear faces of a retaining wall block being formed.
Figure 17:
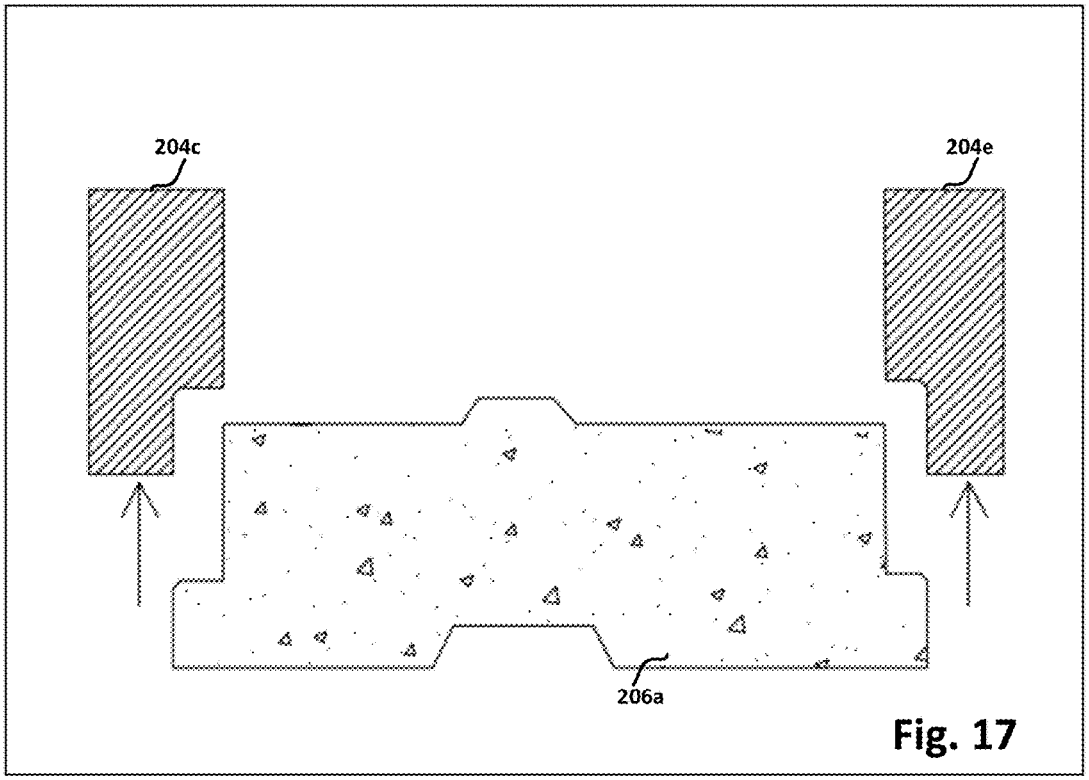
FIG. 17 is an elevational side view of the mold box sidewalls of FIG. 16 being withdrawn vertically upward from contact with the retaining wall block that has been formed having shelf ledges.

However, shelf ledges, being oriented oppositely to overhang ledges, present a challenge for quality, density and finish as compared with overhang ledges, when using this mold box approach. FIG. 16 is an elevational side view of the compression force onto dry mix concrete 206 that has been poured into an area bounded by overhangs 204*c* and 204*e* in the mold box (overall mold box not shown) to form shelf ledges on front and rear faces of a retaining wall block 206*a* being formed. FIG. 17 is an elevational side view of the recessed mold sidewalls of FIG. 16 being withdrawn from contact with the block 206*a* that has been formed with shelf ledges. Creation of a shelf ledge might be thought to involve adding a rigid protrusion to the upper portion of the interior mold sidewall as shown in FIG. 16, in order to create the desired geometry for the shelf ledge on the face of the block. Furthermore, from a mold-extraction point of view, adding such protrusions 204*c* and 204*e* to the upper portion of the mold sidewall would be possible since the mold is lifted upwards to eject the blocks 206*a*, as shown in FIGS. 16 and 17.

Figure 18:
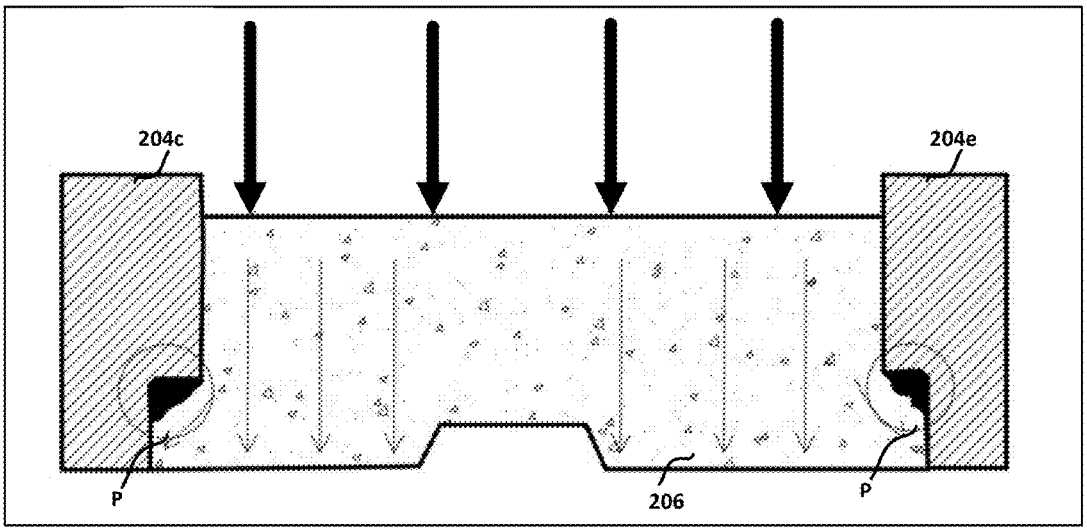
FIG. 18 is an elevational side view of the compression force onto dry mix concrete, similar to FIG. 16, but illustrating more particularly the lack of sufficient dry mix concrete and direct downward compression force in the recesses of the mold box sidewalls corresponding to the shelf ledges being formed.

In practice, however, experience and trial and error of the inventors has shown that the creation of an obstruction in the mold cavity by the provision of such sidewall protrusions hinders the path of the concrete mix from sufficiently filling into the void underneath the protrusions. This also prevents direct compaction onto the dry mix underneath the protrusions and thus prevents the compaction force from being fully applied to this portion of the block to be formed. The result of this is depicted in FIG. 18, which is an elevational side view of the compression force onto dry mix concrete. FIG. 18 is similar to FIG. 16, but illustrates at areas P more particularly the lack of sufficient dry mix concrete and direct downward compression force in the regions underneath the draw fingers corresponding to the shelf ledges being formed. Examples of the areas in which there may arise a lack of concrete are shown as solid black within areas P to contrast with the concrete itself.

Because getting dry cast concrete down and under an overhang in the mold is challenging to do reliably, and because compaction force on a quantum of such dry cast concrete underneath the mold overhang is indirect, the "shelf" ledge that is created in this void under the mold sidewall protrusion tends to be filled and compacted insufficiently. This results in regions of poor density concrete and rough, crumbly surfaces. Such regions are often referred to as "Popcorn" concrete (an industry term used to describe a crumbly, open or perforated surface in the concrete product), and is associated with overall poor appearance and long-term performance problems as the density of the concrete is directly related to long term durability.

As such, while the mold box approach can be used to produce blocks of opposite orientations (shelf ledges), improvements are desirable.

According to embodiments of the present invention, blocks are manufactured with the ledge being at the top of the block (overhang type) during molding, using draw fingers of the mold apparatus. This ensures that the ledges are well filled and well compacted, as they are open to the top surface and in direct contact with the press head for direct compaction. However, to achieve the shelf ledge in the retaining wall to be installed, these same blocks include features enabling them to each be oriented upside down or right side up, front-facing or rear-facing, and installed either at the foundation of a retaining wall or upon lower, similar, blocks, thereby making the ledge that is produced in the mold this way functional for use either as an overhang ledge or a shelf ledge, depending on how the block is oriented.

As will be illustrated, for a block to be usable either upside down or right side up in a practical installation scenario, numerous features are incorporated. For example, according to embodiments of the present invention, the block incorporates a shear interlock system having both a vertical interlock system and a lateral interlock system that work with adjacent like blocks in various relative orientations, along with wall alignment features for ensuring the installation remains uncomplicated and reliable for the installer. As will be described, the installer is generally provided with the freedom to construct a wall using blocks as he or she sees fit.

Figure 19:
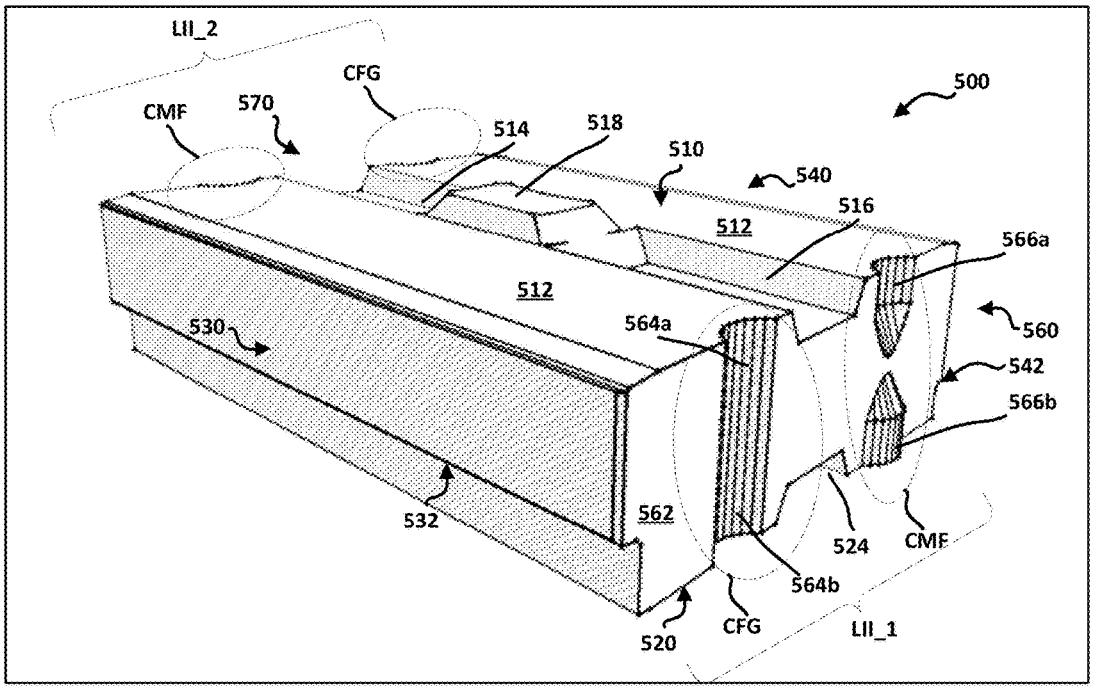
FIG. 19 is an isometric view of a segmental retaining wall block, according to an embodiment of the invention.

FIG. 19 is an isometric view of a segmental retaining wall block 500, according to an embodiment of the invention. According to the invention, block 500 is formed such that it could be successfully installed as part of a retaining wall with other like blocks either right side up, or upside down, whether forward facing or rearward facing with respect to adjacent blocks. Block 500 incorporates particular features to allow for this flexibility, as will be described below.

Retaining wall block 500 includes a block body that includes a top side 510 and a bottom side 520 opposite the top side 510, a front side 530 and a rear side 540 opposite the front side 530, and a right side 560 and a left side 570 opposite the right side 560. Each of front side 530 and rear side 540 presents a respective ledge 532, 542 by providing two rectangular, planar surfaces extending at respective different distances from block 500. That is, one outer planar surface and one recessed planar surface. In this embodiment, the front and rear ledges are at different heights. In this embodiment, retaining wall block 500 is tapered, such that front side 530 has a different lateral width than that of rear side 540. That is, right side 560 and left side 570 do not run in parallel. This tapering provides a wedged retaining wall block 500 enabling additional flexibility for the installer not only in aesthetic design, but also in being able to selectively produce curves or straights in a retaining wall being built.

Retaining wall block 500 also includes a lateral interlock system for enabling retaining wall block 500 to laterally interlock with another, like, block 500 for constructing a retaining wall with the blocks 500. In this embodiment, the lateral interlock system includes a first lateral interlock interface LII_1 that is integral with the right side 560 of the retaining wall block 500 (towards bottom-right of page in FIG. 19) and a second lateral interlock interface LII_2 that is integral with the left side 570 of the retaining wall block 500 (towards top-left of page in FIG. 19).

In this embodiment, each of the first and second lateral interlock interfaces LII_1, LII_2 includes a male-type lateral interface component M and three female-type lateral interface components F. For example, in lateral interlock interface LII_1 in right side 560 of retaining wall block 500, the male-type lateral interface component M is identified using reference numeral 566*b*, and the female-type lateral interface components F are identified respectively using reference numerals 564*a*, 564*b*, and 566*a*. Similarly, in lateral interlock interface LII_2 in left side 570 of retaining wall block 500, the male-type lateral interface component M is identified using reference numeral 576*b*, and the female-type lateral interface components F are identified respectively using reference numerals 574*a*, 574*b* and 576*a*.

It will be understood that each male-type lateral interface component M and female-type lateral interface components F is sized, shaped and positioned such that a male-type lateral interface component of one block 500 is receivable within or otherwise receivable by the female-type lateral interface components F of another like block 500 in a way that enables the blocks 500 to laterally interlock while they are closely abutting.

Furthermore, each of the lateral interface components M, F are in vertical alignment with one of the other lateral interface components of the same lateral interlock interface LII_1 (LII_2) and in horizontal alignment with still another of the lateral interface components of the same lateral interlock interface LII_1 (LII_2), as will be described in further detail below.

In this embodiment, each male-type lateral interface component M comprises a semi-conical portion integral with a semi-cylindrical portion and each extending from a respective side wall 560, 570. The semi-cylindrical portion provides the advantage of not presenting any particularly sharp edges that could easily be chipped off during formation, handling, or installing of a retaining wall. The semi-conical portion provides the advantage of, during formation in a mold, enabling dry-cast concrete material to flow into the mold and be somewhat directly compacted due to not being shielded fully from direct compaction by the mold features.

Furthermore, in this embodiment the first lateral interlock interface LII_1 and the second lateral interlock interface LII_2 are the same, such that each male-type lateral interface component M extends upwards from the bottom side 520 of the block body and from opposite corners. This is a configuration that facilitates molding using a mold element that will have to be lifted vertically upward and off of the blocks 500 after the dry cast concrete from which they are being made is compacted. In contrast, an alternative embodiment involving the same configuration but rotated 180 degrees (as will be described herein as an alternative) such that one of the male-type lateral interface components M extending downwards from the top side 510 of the block body could be a useful block, but would be more complex to actually mold since to form this component would mean having a corresponding mold component underneath the formed male-type lateral interface component M, such that the thus-formed male-type lateral interface component M would present an obstruction to lifting a mold component vertically upwards after the compaction.

In the embodiment of block 500, two of the female-type lateral interface components F of a lateral interlock interface that are in vertical alignment (for LII_1, these identified by reference numbers 564*a* and 564*b*) actually together are part of, or form in combination, a continuous female-type groove CFG that is semi-cylindrical and extends vertically through the block body from the top side 510 to the bottom side 520. As will be described, integrating the two female-type lateral interface components F as a single groove CFG as opposed to being mutually-distinct female-type cavities or compartments enables the functionality of the inventive block 500 to be achieved while having block 500 formed from a single corresponding mold feature (not shown, but correspondingly semi-cylindrical element extending positively into the mold cavity from the mold wall) that may be lifted vertically upwards and/or outwards after compaction during formation of block 500.

Furthermore, the female-type lateral interface component F and the male-type lateral interface component M that are in vertical alignment (for LII_1, these are identified by reference numerals 566*a* and 566*b*) together form a combination male-female CMF interface element that extends vertically through the block body from the top side 510 to the bottom side 520. As shown, the female-type lateral interface component F of the CMF interface element (that is, element 566*a* in LII_1 and 576*a* in LII_2) comprises a semi-conical portion integral with a semi-cylindrical portion. Similar to the male-type lateral interface components M, the semi-cylindrical portion of each female-type lateral interface component F of each CMF interface element provides the advantage of not presenting any particularly sharp edges that could easily be chipped off during formation, handling, or installing of a retaining wall. Furthermore, its semi-conical portion provides the advantage of, during formation in a mold, enabling dry-cast concrete material to flow into the mold and be somewhat directly compacted and not shielded fully from direct compaction by the mold features themselves.

Figure 20:
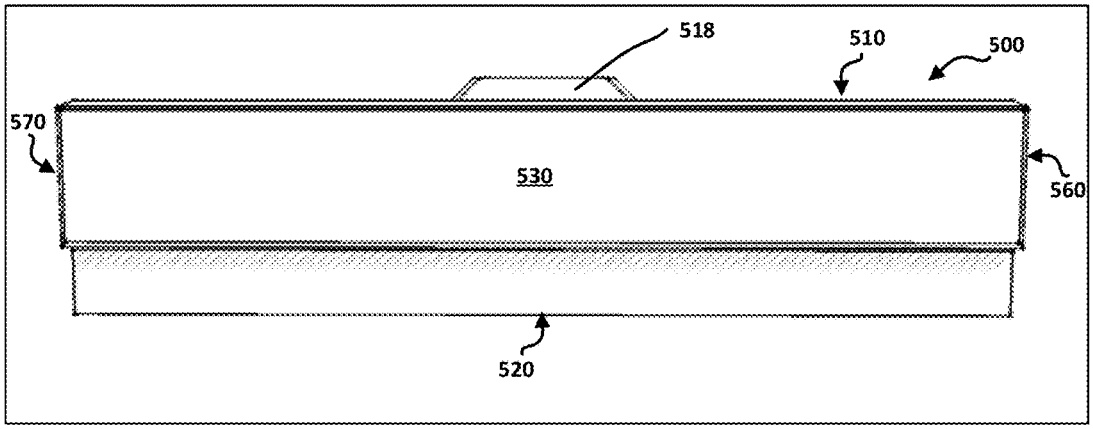
FIG. 20 is an elevational view of the front of the segmental retaining wall block of FIG. 19.
Figure 21:
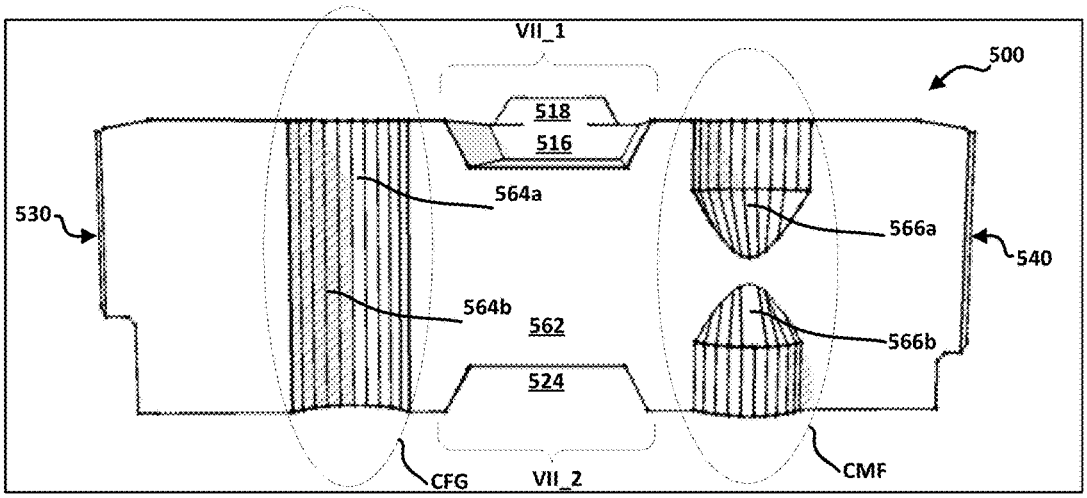
FIG. 21 is an elevational view of a first side of the segmental retaining wall block of FIG. 19.
Figure 22:
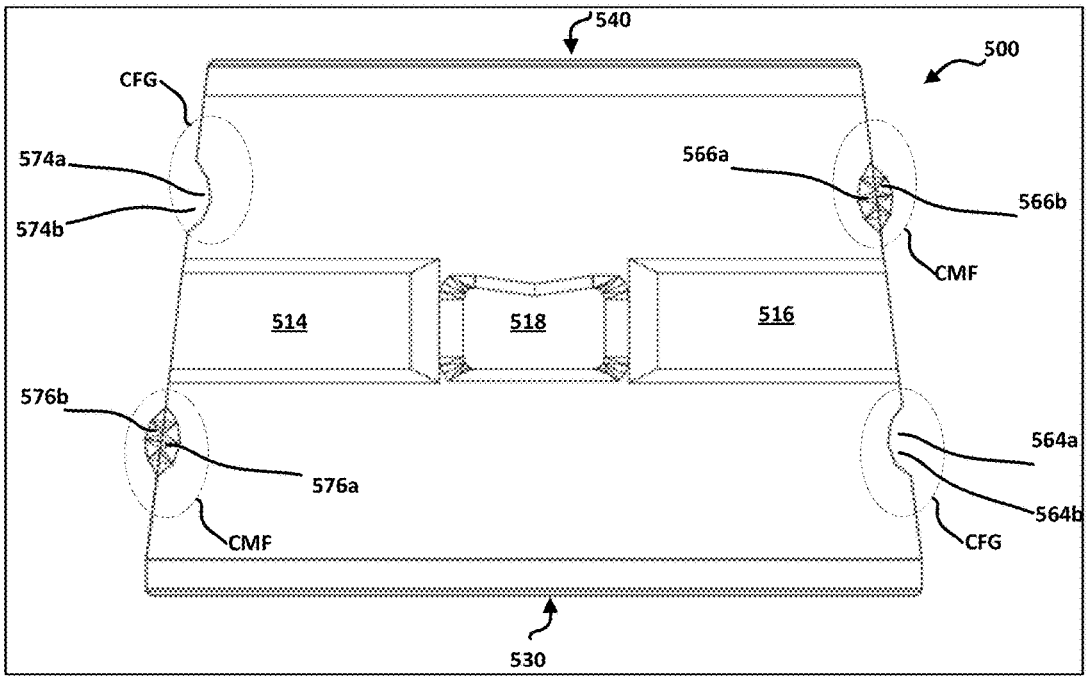
FIG. 22 is a top plan view of the segmental retaining wall block of FIG. 19.

FIG. 20 is an elevational view of the front side 530 of the segmental retaining wall block 500. FIG. 21 is an elevational view of the right side 560 of the segmental retaining wall block 500, and FIG. 22 is a top plan view of the top side 510 of segmental retaining wall block 500. In this embodiment, the second lateral interlock interface LII_2 has a similar configuration to the first lateral interlock interface LII_1. In particular, the first lateral interlock interface LII_1 and the second lateral interlock interface LII_2 are, when viewed in elevation, identical. What identical is intended to mean in the context of the lateral interlock interfaces LII_1, LII_2 is not necessarily indistinguishable, but that the M, F, F, F lateral interface components of the first lateral interlock interface LII_1 are positioned, shaped, and configured similarly enough to the M, F, F, F lateral interface components of the second lateral interlock interface LII_2 such that, were the first lateral interlock interface LII_1 able to be separated from retaining wall block 500 and then presented to the second lateral interlock interface LII_2, these lateral interlock interfaces LII_1, LII_2 would be able to laterally interlock with each other while the respective sides with which they were associated were abutting. Therefore, two male-type lateral interface components M of facing lateral interlock interfaces each face and can be received by female-type lateral interface components F in the opposite block. Male-type lateral interface components M of facing lateral interlock interfaces do not face each other and thus do not prevent a lateral interlock. As will be described, this is the case whether or not one of the two facing lateral interlock interfaces is upside-down/right-side up and/or front-facing/rear-facing with respect to the other. As such, the configuration of the left and right lateral interlock interfaces LII_1, LII_2 enable an installer of a retaining wall to construct a wall using several retaining wall blocks 500 while being able to choose whether each individual block 500 is to be upside-down/right-side up and/or front-facing/rear-facing as will be described, while still providing lateral interlocking between blocks 500 for retaining wall structural integrity.

Despite the two vertically-aligned female-type lateral interface components F (formed as a CFG) being located towards the front side 530 of the retaining wall block 500 on the first lateral interlock interface LII_1 but located towards the rear side 540 of the retaining wall block 500 on the second lateral interlock interface LII_2 such that when viewed from the top side 510 they would be at opposite corners of the retaining wall block 500 (see FIG. 22), were the first and second lateral interlock interfaces LII_1, LII_2 viewed in elevation from respective right or left sides 560, 570, the first and second lateral interlock interfaces LII_1, LII_2 themselves would appear identical. That is, while the sides 560, 570 themselves might present slightly differently due perhaps to features on the top side 510, bottom side 520, front side 530 and rear side 540, it is the case that the first and second lateral interlock interfaces LII_1 and LII_2 themselves would present identically for lateral interlocking purposes.

Referring to FIG. 21, in this embodiment retaining wall block 500 also includes a vertical interlock system comprising a first vertical interlock interface VII_1 that is integral with the top side 510 and in vertical alignment with a second vertical interlock interface VII_2 that is integral with the bottom side 520. Also, in this embodiment, the first vertical interlock interface VII_1 comprises a male-type vertical interface component, in this embodiment a lug 518, flanked by two female-type vertical interface components, in this embodiment grooves 514, 516. Lug 518 has a V-shaped face, best seen in FIG. 22, to promote flexibility in placement of the blocks 500 atop each other during installation of a curved wall.

Furthermore, the second vertical interlock interface VII_2 comprises a female-type vertical interface component, in this embodiment a groove 524. It will be understood that the male-type vertical interface component and female-type vertical interface components are sized, shaped and positioned such that a male-type vertical interface component of one block 500 is receivable by the female-type vertical interface components of another like block 500 in a way that enables the blocks 500 to vertically interlock while they are closely abutting. In this embodiment, the walls of the vertical interface components are ramped for ease of formation using mold components and for ease of stacking during installations.

The features of the first and second vertical interlock interfaces VII_1 and VII_2 are such that block 500 may be installed atop another like block 500 either right side up or upside down, front-facing or rear-facing, regardless as to whether the underlying block 500 is itself right side up or upside down, front-facing or rear-facing. The lug 518 may be received by either groove 514 or 516, respectively, of two vertically-adjacent blocks, may be received by groove 524 of two vertically adjacent blocks, or may be received by groove 524 of one block and either groove 514 or 516 of another block. This is because the vertical interlock system provides interlocking for a "stack bond" pattern of block stacking, whereby each course is offset a distance equal to half the block width from the course below it. It will be understood that in some orientations, two vertically-adjacent blocks 500 may not vertically interlock due to the two blocks 500 being oriented in the retaining wall such neither block is presenting a male-type vertical interface component to the other. It will be understood, however, that due to the configuration of the lateral interlock system, two laterally adjacent blocks 500 will be able to laterally interface with each other in this event, thereby to resist shear forces.

Figure 23:
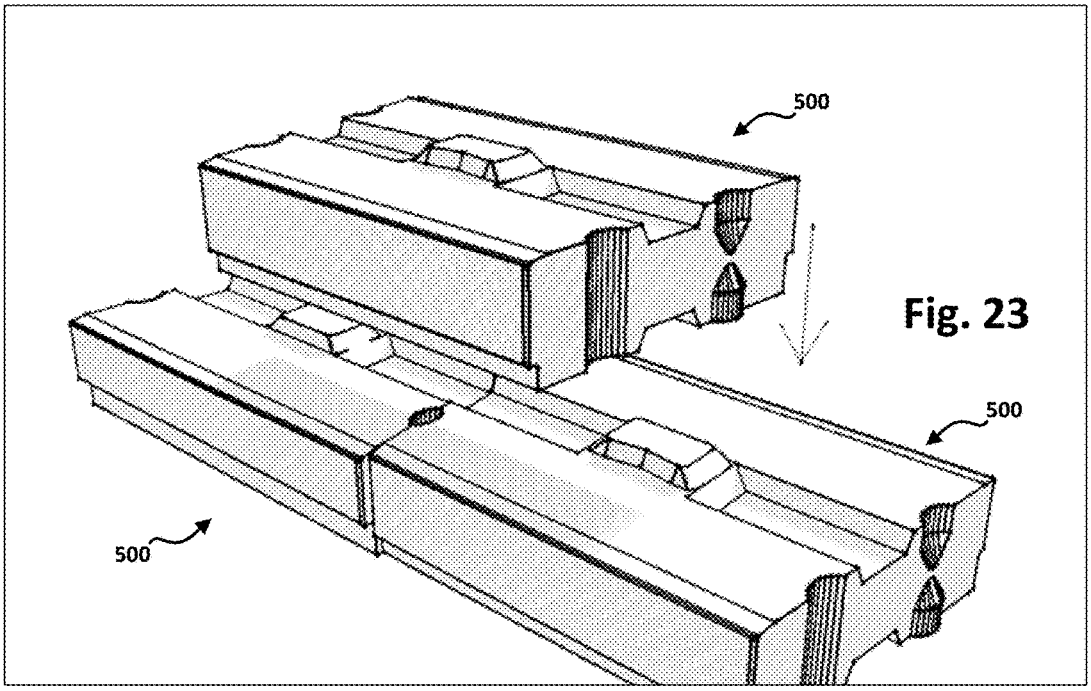
FIGS. 23 and 24 are isometric views of the segmental retaining wall block of FIG. 19 in a "right side up" and "front-facing" orientation being installed atop, and having been installed atop, two like segmental retaining wall blocks that are each installed in the "right-side up" and "front-facing" orientation.
Figure 24:
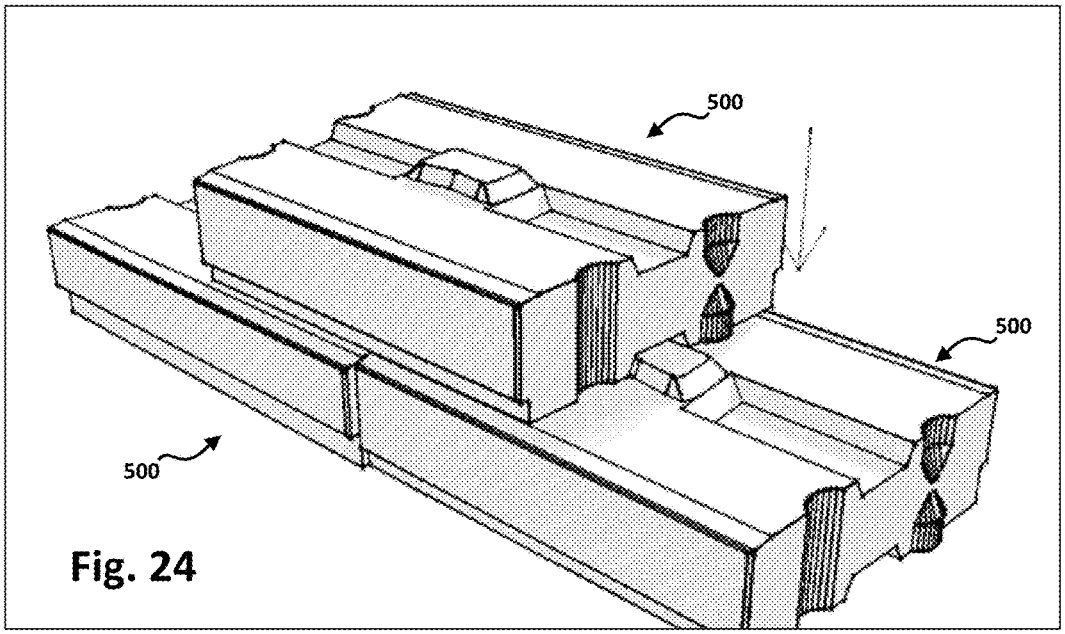

FIGS. 23 and 24 are isometric views of the segmental retaining wall block 500 in a "right side up" and "front-facing" orientation being installed atop, and having been installed atop, two like segmental retaining wall blocks 500 that are each installed in the "right-side up" and "front-facing" orientation. It can be seen that, in this relative orientation, the female-type vertical interface component of the second vertical interlock interface in the upper block 500 receives a portion of the male-type vertical interface component of two lower blocks 500 when stack bonded. All three blocks 500 in these figures present overhang ledges since they are all "right-side up".

Figure 25:
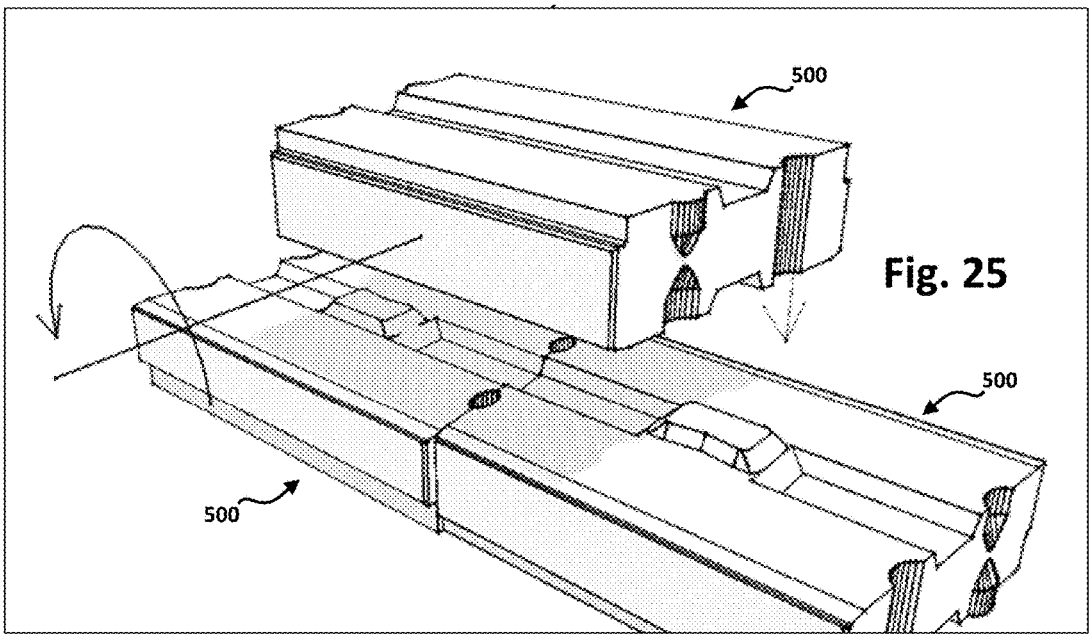
FIGS. 25 and 26 are isometric views of the segmental retaining wall block of FIG. 19 in an "upside down" and "front-facing" orientation being installed atop, and having been installed atop, two like segmental retaining wall blocks that are each installed in the "right-side up" and "front-facing" orientation.
Figure 26:
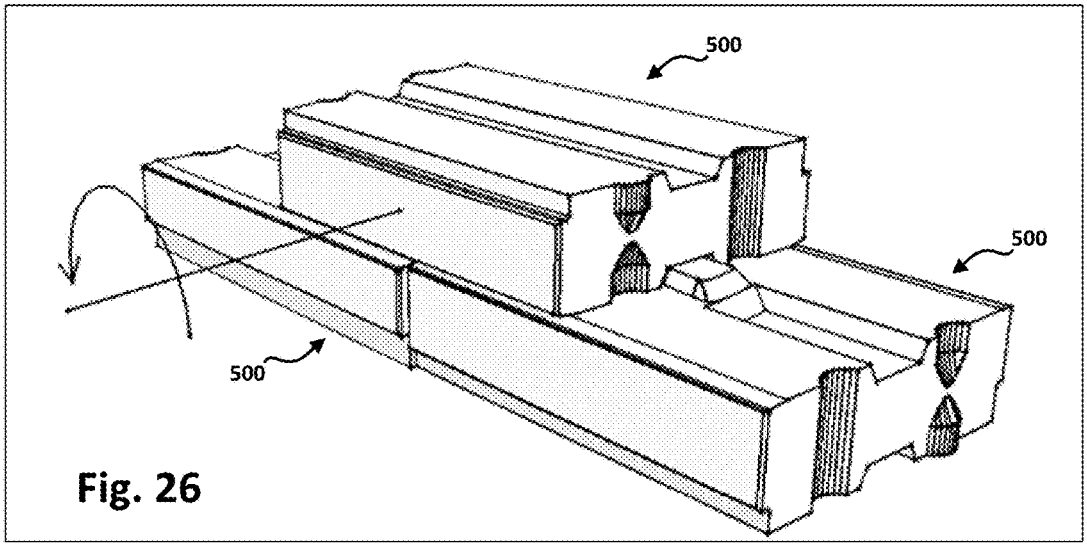

FIGS. 25 and 26 are isometric views of the segmental retaining wall block 500 in an "upside down" and "front-facing" orientation being installed atop, and having been installed atop, two like segmental retaining wall blocks 500 that are each installed in the "right-side up" and "front-facing" orientation. It can be seen that, in this relative orientation, each female-type vertical interface component of the first vertical interlock interface in the upper block 500 receives a portion of a respective male-type vertical interface component of a respective one of two lower blocks 500 when stack bonded. The upper block 500 presents a shelf ledge since it is "upside down", whereas the lower blocks present respective overhang ledges.

Figure 27:
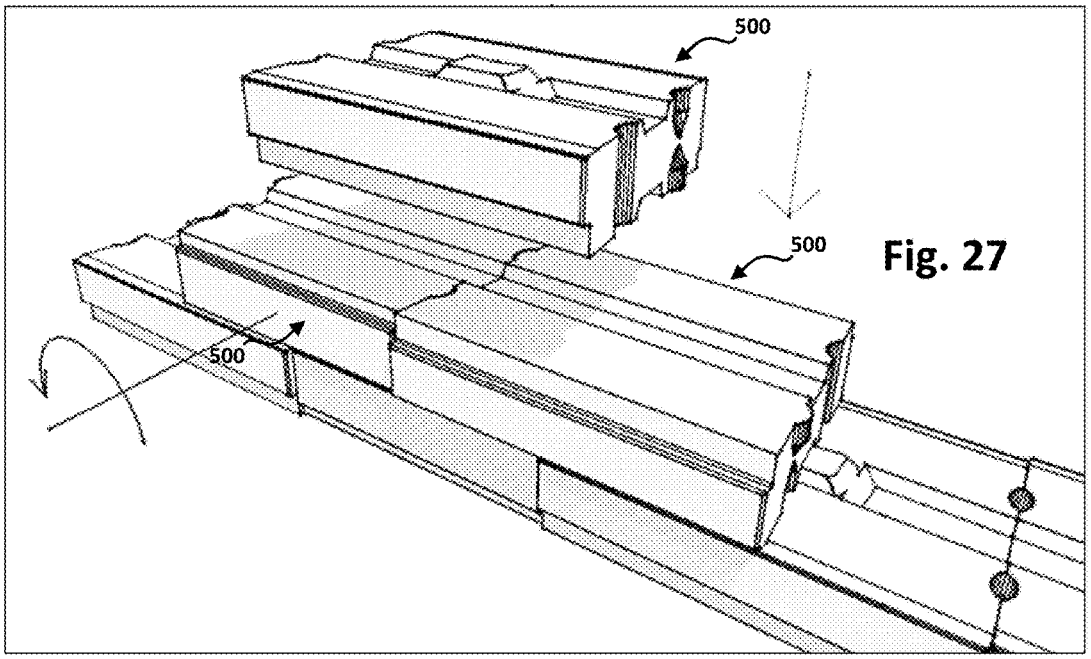
FIGS. 27 and 28 are isometric views of the segmental retaining wall block of FIG. 19 in a "right side up" and "front-facing" orientation being installed atop, and having been installed atop, two like segmental retaining wall blocks that are each installed in the "upside down" and "front-facing" orientation.
Figure 28:
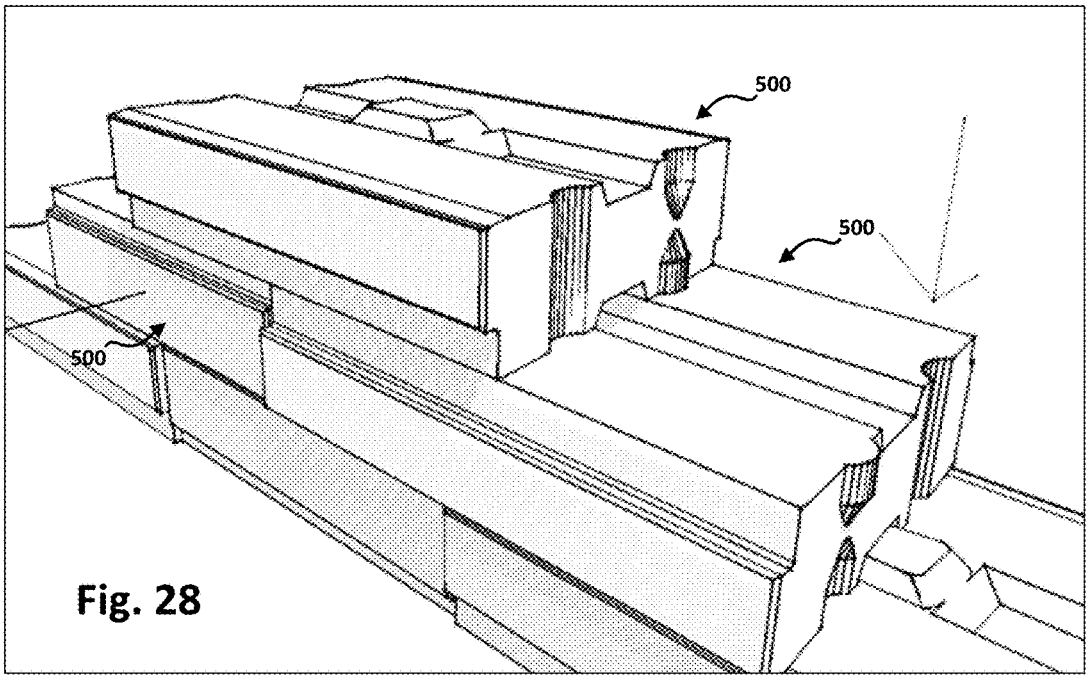

FIGS. 27 and 28 are isometric views of the segmental retaining wall block 500 in a "right side up" and "front-facing" orientation being installed atop, and having been installed atop, two like segmental retaining wall blocks 500 that are each installed in the "upside down" and "front-facing" orientation. It can be seen that, in this relative orientation, each of the female-type vertical interface components of the upper and lower blocks 500 face each other. As such, there is a "gap" in the vertical interlock due to there being no vertical interlock between the subject blocks 500. The shear forces from lateral earth pressure are not being resisted at this location in the wall by a vertical interlock system. However, as described herein lateral interlocking provided by the lateral interlock systems interacting between laterally adjacent blocks in a more completed wall will provide sufficient resistance to the shear forces in the presence or absence of a vertical interlock. The upper block 500 presents an overhang ledge while each of the lower blocks 500 presents a respective shelf ledge.

Figure 29:
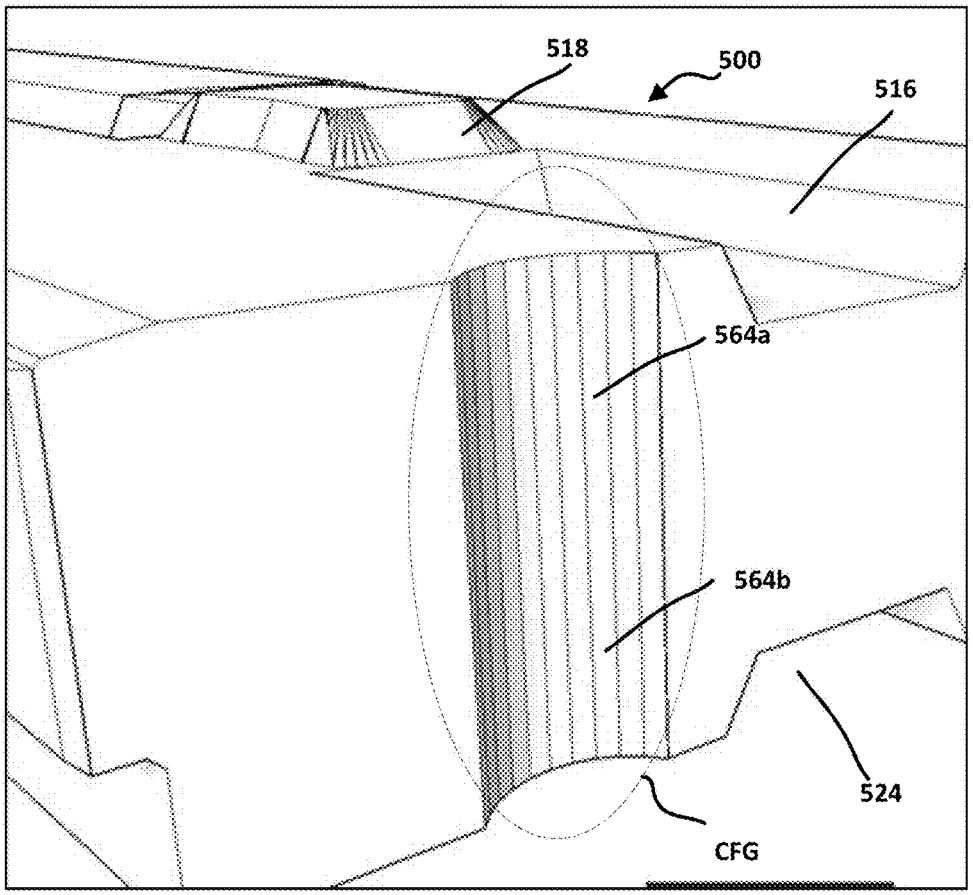
FIG. 29 is an isometric view of a portion of a side and the top of the segmental retaining wall block of FIG. 19 when in a "right-side up" and "front-facing" orientation, including a continuous vertical female groove in the side.
Figure 30:
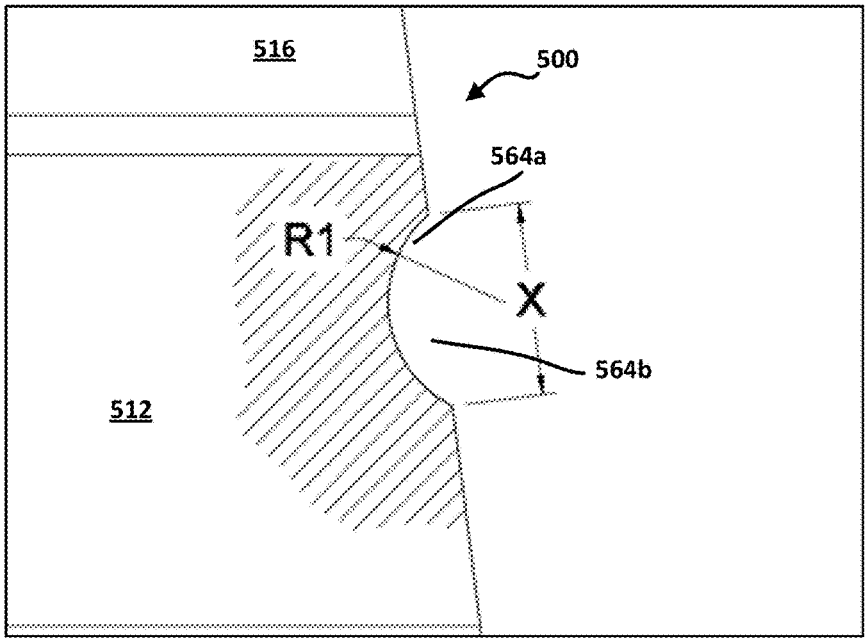
FIG. 30 is a plan view of a portion of the top of the segmental retaining wall block of FIG. 19 and the continuous vertical female groove.

FIG. 29 is an isometric view of a portion of right side 560 and top 510 of the segmental retaining wall block 500 when in a "right-side up" and "front-facing" orientation, including a continuous female groove CFG in the side 560 presenting female-type lateral interface components 564*a* and 564*b*. The continuous female groove CFG is an arced (semi-circular, in this embodiment) concave shape in side face 562 spanning from the top surface 512 to the bottom surface 522 of block 500. The continuous female groove CFG is formed using a positive protrusion in the mold sidewall extending inwards. The continuous female groove CFG is sized and shaped to receive a male-type lateral interface component. In this embodiment, the semi-circular shape of the continuous female groove CFG also allows for good flow of the wet concrete into the mold cavity, and has few concrete stress points due to not having any particularly sharp edges. FIG. 30 is a plan view of a portion of the top of the segmental retaining wall block 500 and the continuous female groove CFG. The dimension X shown in FIG. 30 is sized proportionally to the overall depth of block 500 (that is, the distance between front 530 and back 540). In the embodiment shown, X is approximately 15%-20% of the block depth, with R1 being a radius as shown.

Figure 31:
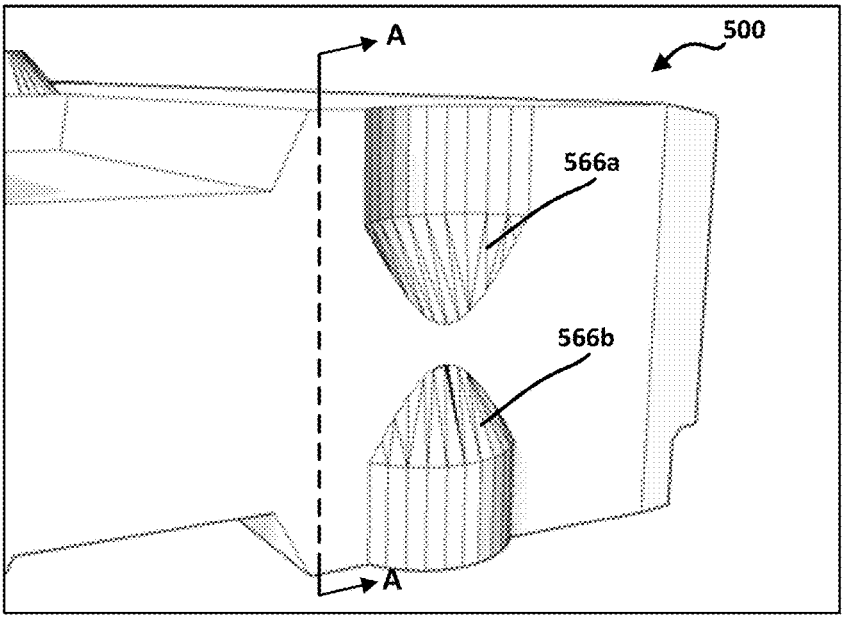
FIG. 31 is an isometric view of another portion of the side and the top shown in FIG. 29 of the segmental retaining wall block of FIG. 19, including a combination female/male element.

FIG. 31 is an isometric view of another portion of the side 560 and the top 510 shown in FIG. 30 of the segmental retaining wall block 500, including a combination male-female interface element CMF in the side 560 presenting a female-type lateral interface component 566*a* vertically-aligned with a male-type lateral interface component 566*b* below it. The female-type lateral interface component 566*a* is formed using a positive protrusion in the mold sidewall extending inwards, and the male-type lateral interface component 566*b* is formed using a negative cavity in the mold sidewall extending outwards. The female-type lateral interface component 566*a* has a maximum size that corresponds to that of the continuous female groove CFG with respect to shape and radius, as it is intended to also be able to receive a male-type lateral interface component of an adjacent block 500. In this embodiment, each male-type lateral interface component 566*b* is dimensioned slightly smaller than the female-type lateral interface components 566*a*, 564*a*, 564*b* could accommodate, in order to allow for some play between adjacent blocks 500 and/or manufacturing tolerances.

Figure 32:
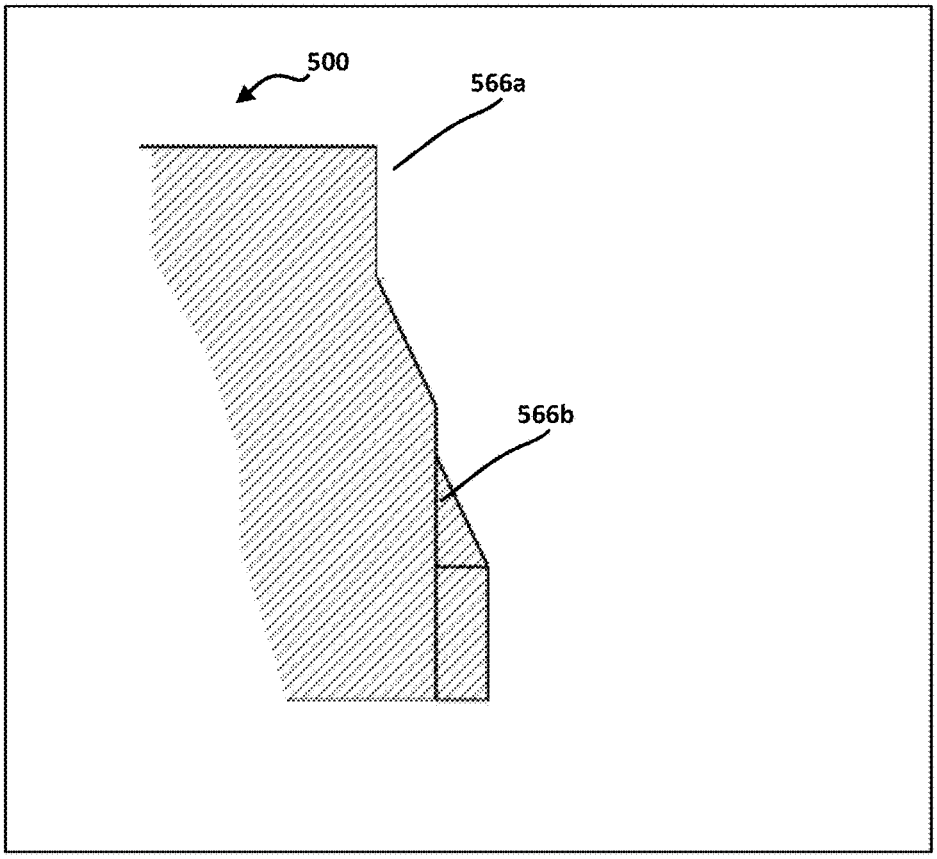
FIG. 32 is an elevational sectional view of the segmental retaining wall block of FIG. 28, when seen from the perspective cuts at A-A in FIG. 31.

FIG. 32 is an elevational sectional view of the segmental retaining wall block of FIG. 28, when seen from the perspective cuts at A-A in FIG. 31. It will be noted that the bottom portion of the female-type lateral interface component 566*a* is sloped downward from the inside, to the outside wall 562 of block 500 on side 560 (shown as angle Z). Since a protrusion in the mold sidewall forming female-type lateral interface component 566*a* can act as an obstruction to filling and compaction of the concrete beneath the protrusion during production, the transition from the innermost portion towards the bottom of the female-type lateral interface component 566*a* to the outermost portion at its bottom is gradual (sloped). In this way, the sloping pitch, which forms a cone, or more particularly a "cone-like" or partial frusto-conical, shape at the bottom of the female-type lateral interface component 566*a*, better promotes the flow of concrete in and around this groove and below it, than a strictly horizontal feature would tend to reliably provide. In the embodiment shown in FIG. 32, this angle Z is approximately 25 degrees. While this angle Z could vary depending on the flowability of the concrete mix design, it is preferably gradual for the reasons given above. In alternative embodiments, the bottom of the female-type lateral interface component 566*a* could be horizontal or nearly-horizontal, though to the extent that this is horizontal there is the potential of filling and compaction difficulties and thus the potential of popcorn concrete areas.

In this embodiment, the female-type lateral interface component 566*a* of has a vertical height of approximately H/4 (the height of the block divided by 4). This dimension may vary. However, it will be understood that the dimensions must take into account that a substantially similar lower male-type lateral interface component 566*b* is required and both portions (upper female-type and lower male-type) are preferred to incorporate gradual slopes leading out of (female-type) and in to them (male-type).

In this embodiment, the male-type lateral interface component 566*b* is congruent with the female-type lateral interface component 566*a,* and is formed below and in vertical alignment with the female-type lateral interface component 566*a.* As the male-type lateral interface component 566*b* is formed with a negative "pocket" in the sidewall of the mold, and it is below the positive sidewall protrusion for creating the upper female-type lateral interface component 566*a,* it is preferred that proper flow of concrete and compaction is ensured. As such, in this embodiment the area at the top of the male-type lateral interface component 566*b* is gradually sloped downwardly in an inverted cone or cone-like or partial frustoconical shape to promote flow of material and distribution of compaction/vibration forces. The male-type lateral interface component 566*b* is shown in this embodiment to have a height that is slightly shorter than the height of the female-type lateral interface component 566*a* (H/4—tolerances), and a depth that is slightly less than the depths of the congruent female-type lateral interface component 566*a,* 564*a,* and 564*b* (D1—tolerances).

Figure 33:
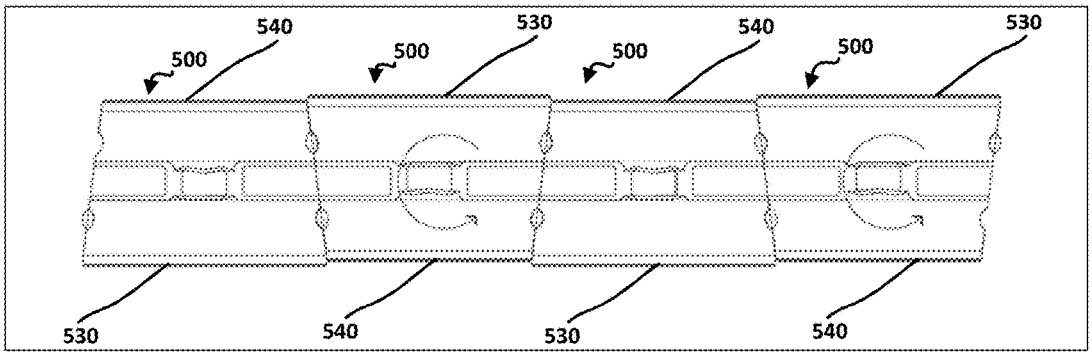
FIG. 33 is a top view of a number of segmental retaining wall blocks such as that shown in FIG. 19, arranged in a series side-by-side and each in a "right-side up" orientation, but alternating through the series in "front-facing" and "rear-facing" orientations, thereby to form an uncurved retaining wall.
Figure 34:
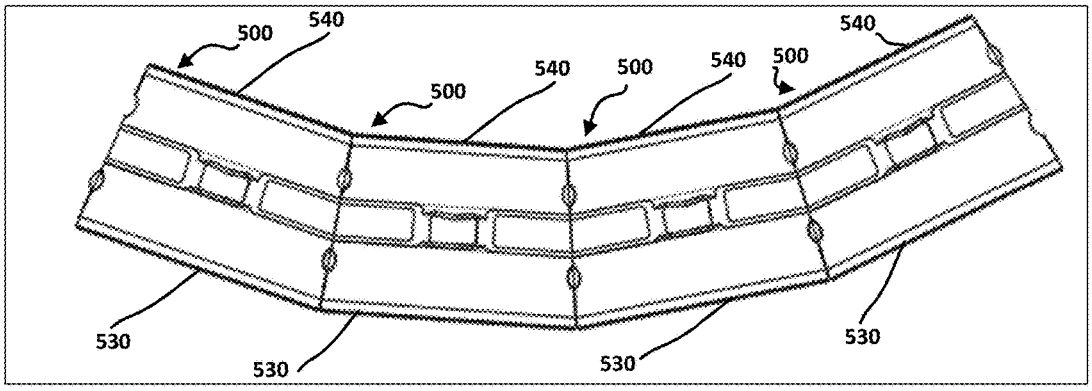
FIG. 34 is a top view of a number of segmental retaining wall blocks such as that shown in FIG. 19, arranged in a series side-by-side and each in a "right-side up" and "front-facing" orientation, thereby to form a curved retaining wall.

As described above, block 500 is tapered from front 530 to back 540 to allow for the construction of either straight walls or curved walls, using a number of the same blocks 500. For example, FIG. 33 is a top view of a number of segmental retaining wall blocks 500, arranged in a series side-by-side and each in a "right-side up" orientation, but alternating through the series in "front-facing" and "rear-facing" orientations, thereby to form an uncurved retaining wall. FIG. 34 is a top view of a number of segmental retaining wall blocks 500, arranged in a series side-by-side and each in a "right-side up" and "front-facing" orientation, thereby to form a curved retaining wall.

Figure 35:
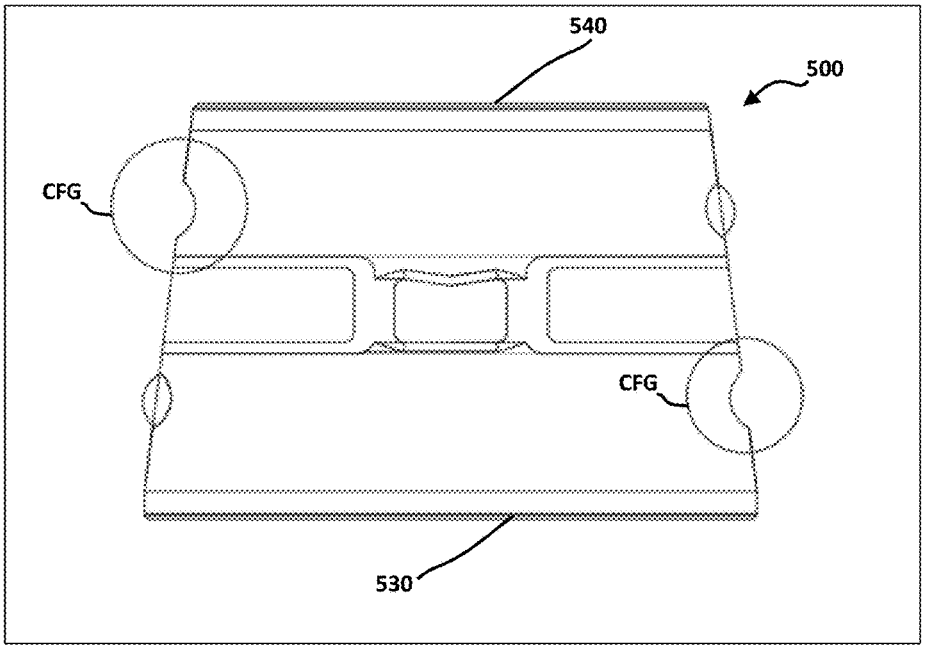
FIG. 35 is another top plan view of the segmental retaining wall block of FIG. 19, showing the opposite positioning on the block's sides of continuous female elements.
Figure 36:
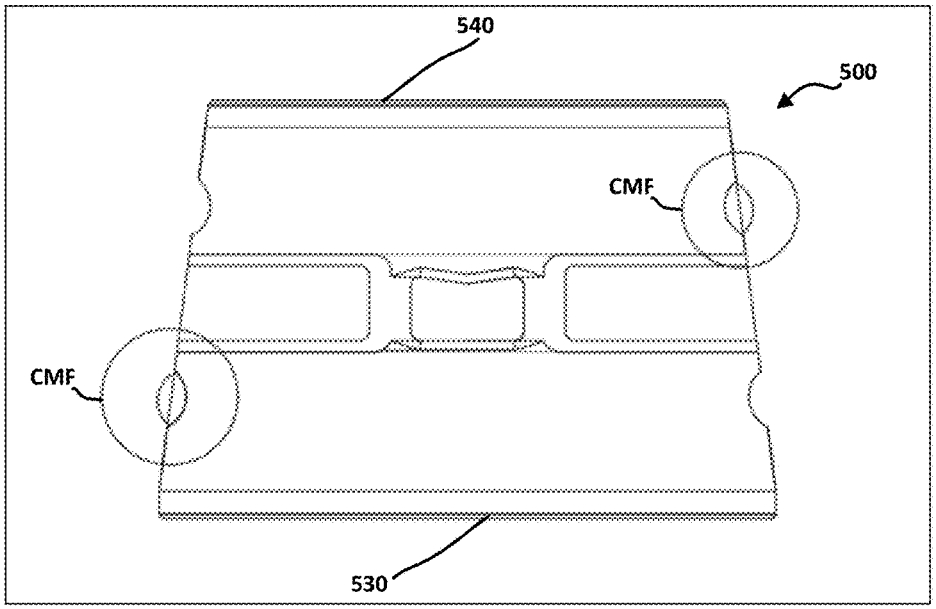
FIG. 36 is another top plan view of the segmental retaining wall block of FIG. 19, showing the opposite positioning on the block's sides of combination male/female elements.

The relative locations in the block 500 of the CFG and CMF interface elements is important for ensuring that a lateral interlock can be provided, regardless of how the blocks 500 are oriented relative to each other. FIG. 35 is another top plan view of the segmental retaining wall block 500, showing the opposite positioning on the blocks' sides of continuous female elements CFG, and FIG. 36 is another top plan view of the segmental retaining wall block of FIG. 19, showing the opposite positioning on the block's sides of combination male-female interface elements CMF. It can be seen that, the CFGs are at opposite corners of the block 500, and the CMF are correspondingly at other opposite corners of the block 500.

With the features of block 500 having been described, installation using a number of blocks 500 in combination will be described below.

Figure 37:
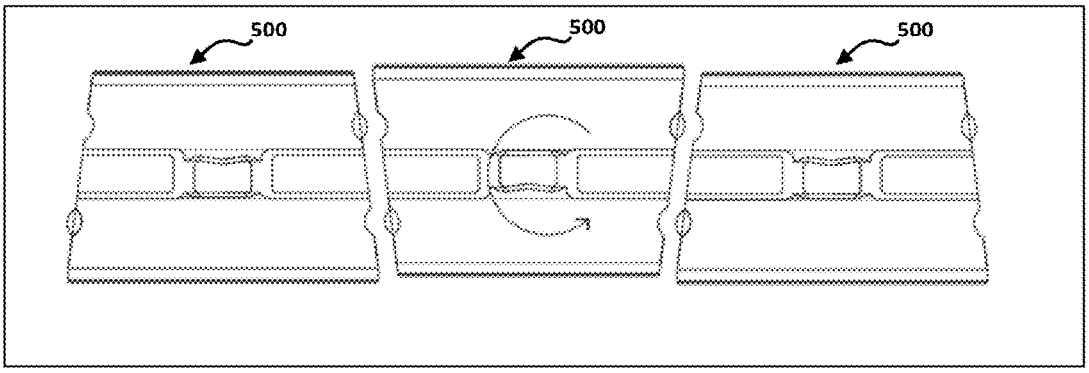
FIG. 37 is a top view of a number of segmental retaining wall blocks similar to that shown in FIG. 33, arranged in a series side-by-side but spaced from each other for illustrating the interactions of the continuous female elements and combination male/female elements with facing counterparts in a side wall of adjacent like blocks.
Figure 38:
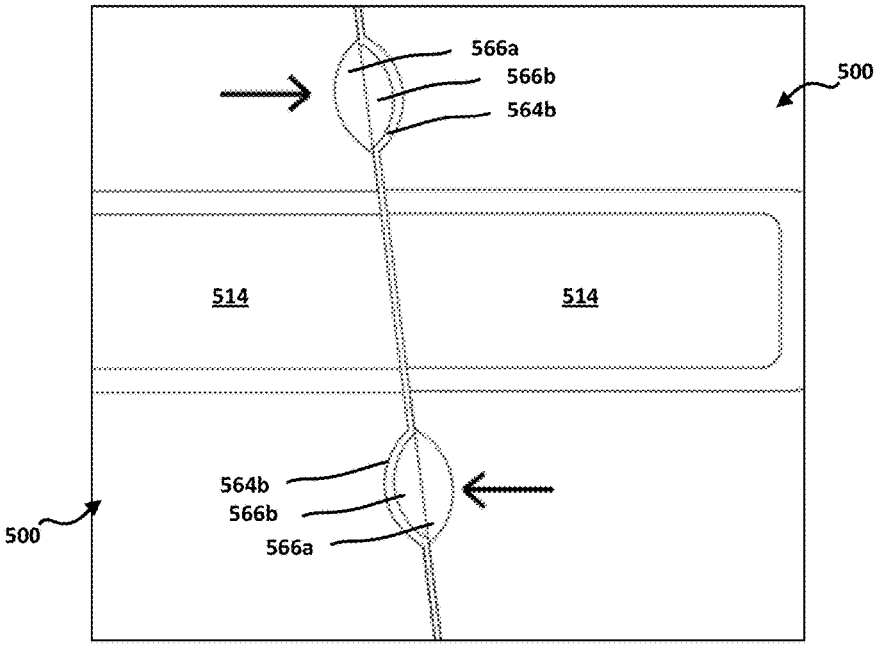
FIG. 38 is an enlarged top view of the interfacing of the sides of two of the adjacent segmental retaining blocks shown in FIGS. 33 and 37.
Figure 39:
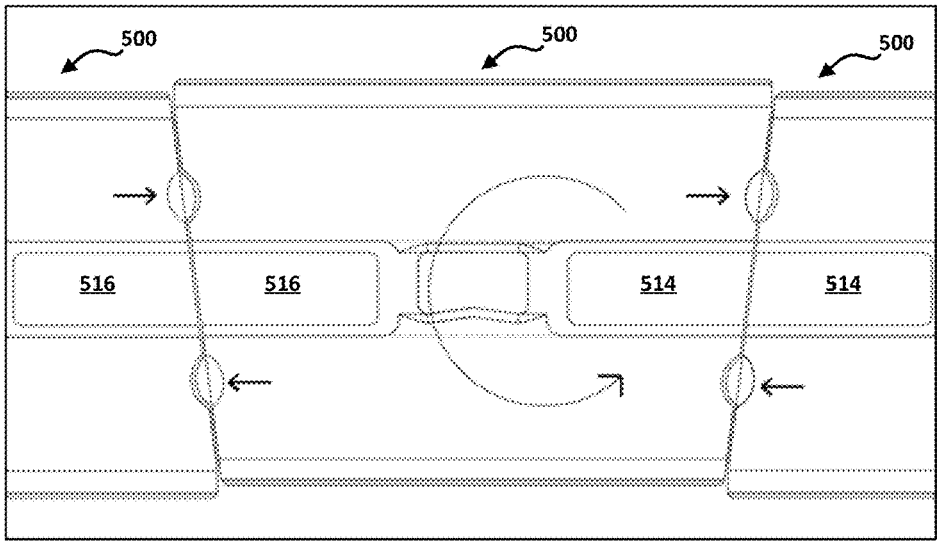
FIG. 39 is an enlarged top view of the central block and its flanking blocks shown in FIG. 37.

FIG. 37 is a top view of a series of segmental retaining wall blocks 500 similar to that shown in FIG. 33, arranged side-by-side but spaced from each other for illustrating the interactions of the continuous female grooves CFG and combination male-female interface elements CMF with facing counterparts in a side wall of adjacent like blocks 500. In FIG. 37, all blocks 500 are right side up but alternate front-facing and rear-facing (i.e., rotated with respect to each other by 180 degrees about an axis going into the page) through the series, thereby to form an uncurved wall with the wedged blocks 500. FIG. 38 is an enlarged top view of the interfacing of the sides of the first and second adjacent segmental retaining blocks 500, and FIG. 39 is an enlarged top view of the central block 500 and its flanking blocks shown in FIG. 37.

It can be seen, particularly with reference to FIG. 38, that while female-type lateral interface component 566*a* of the leftmost block 500 receives no male-type lateral interface component, the female-type lateral interface component 564*b* of the rightmost block 500 (part of the CFG) receives the male-type lateral interface component 566*b* of the leftmost block 500. Similarly, while female-type lateral interface component 566*a* of the rightmost block 500 receives no male-type lateral interface component, the female-type lateral interface component 564*b* of the leftmost block 500 (part of the CFG) receives the male-type lateral interface component 566*b* of the rightmost block 500.

This configuration is the same for the second and third blocks 500 in this series, whereby the CFG of the second block (front corner) interfaces with the CMF of the third block (front corner), and the CMF of the second block (rear corner) interfaces with the CFG of the third block (rear corner), thereby to provide lateral interlocking.

Figure 40:
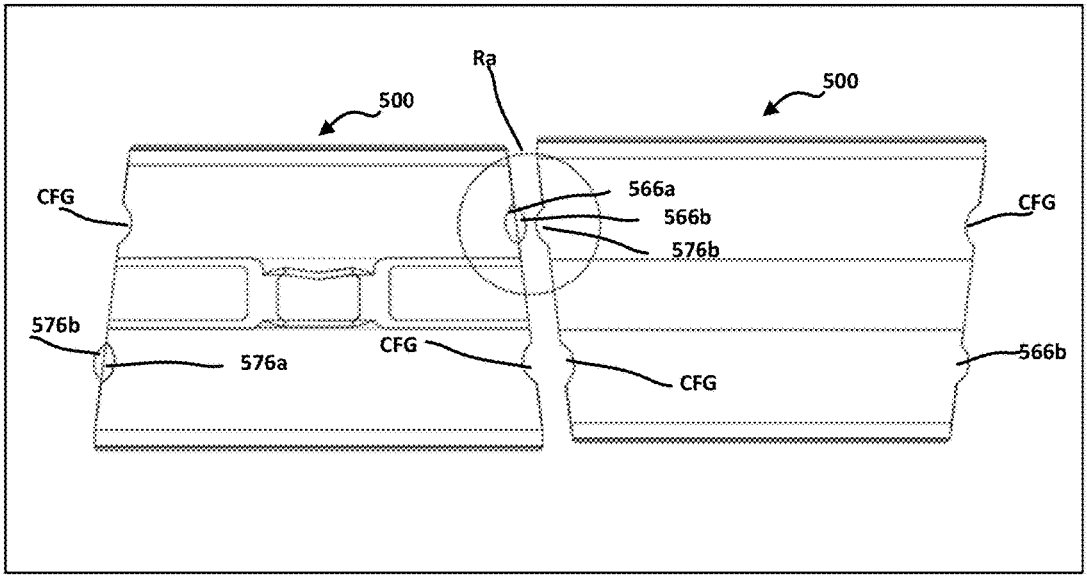
FIG. 40 is a top view of two segmental retaining wall blocks such as that shown in FIG. 19, arranged in a series side-by-side, with one in a "right-side up" orientation and the other in an "upside down" orientation, with the first being in a "front-facing" orientation and the other being in a "rear-facing" orientation, thereby to form part of an uncurved retaining wall such as a wall seen from the front as in FIG. 9.

FIG. 40 is a top view of two segmental retaining wall blocks 500, arranged in a series side-by-side, with one in a "right-side up" orientation and the other in an "upside down"orientation, with the first being in a "front-facing" orientation and the other being in a "rear-facing"orientation, thereby to form part of an uncurved retaining wall such as wall 100 in FIG. 9. In this configuration, the leftmost block 500 presents an overhang ledge at its front and rear sides, but the rightmost block 500 presents a shelf ledge at its front and rear sides, thereby to produce a shelf/ledge counterpoint effect in the front face of the wall being built. It will be noted that, despite the change in relative orientation, the two blocks 500 can laterally interlock. In particular, it can be seen that in the area encircled and labelled Ra, female-type lateral interface component 566*a* of the leftmost block 500 would receive male-type lateral interface component 576*b* of the rightmost block 500, and the female-type lateral interface component 576*a* of the rightmost block 500 would receive the male-type lateral interface component 566*b* of the leftmost block 500. Also, the female-type lateral interface components 564*a* and 564*b* of the leftmost block 500 (part of the CFG) would face the female-type lateral interface components 574*a* and 574*b* of the rightmost block 500 (part of the CFG).

Figure 41:
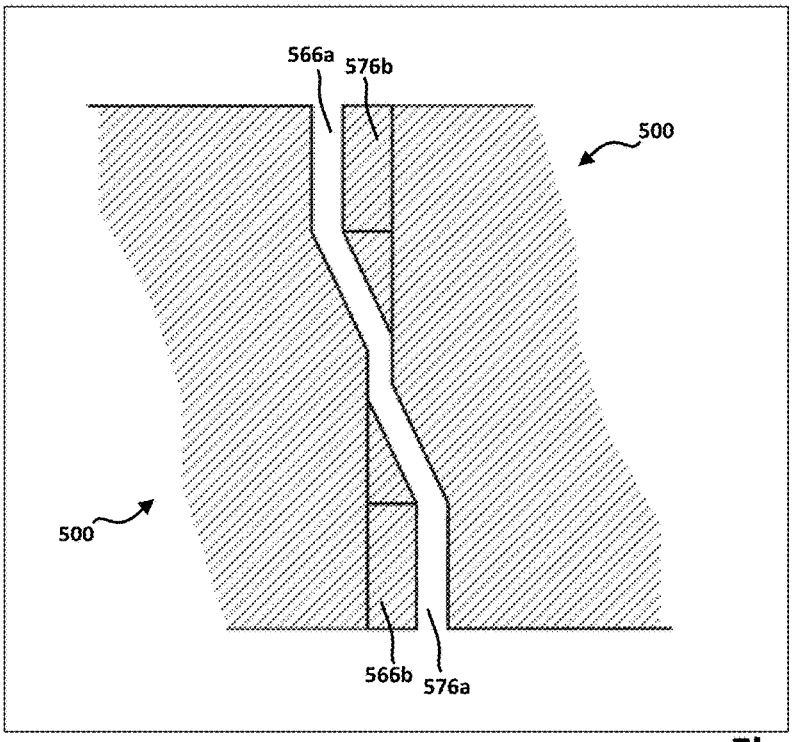
FIG. 41 is a sectional view taken partway between fronts and backs of the two segmental retaining wall blocks shown in FIG. 40, illustrating the interfacing of the sides of the blocks and, in particular, the interfacing of respective combination male/female elements in the sides as the blocks are brought together.

FIG. 41 is a sectional view taken partway between fronts and backs of the two segmental retaining wall blocks 500 shown in FIG. 40, illustrating the interfacing of the sides of the blocks 500 and, in particular, the interfacing of respective combination male/female elements CMF in the sides as the blocks 500 are brought together.

Figure 42:
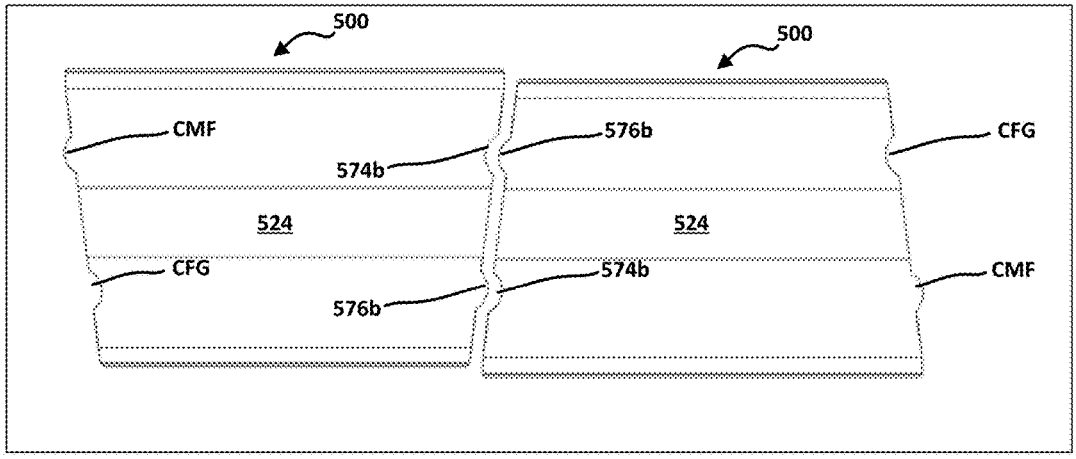
FIG. 42 is a top view of two segmental retaining wall blocks such as that shown in FIG. 19, arranged in a series side-by-side, with both being in an "upside down" orientation and, with the first being in a "rear-facing" orientation and the other being in a "front-facing" orientation, thereby to form part of an uncurved retaining wall such as a wall seen from the front as in FIG. 9.

FIG. 42 is a top view of two segmental retaining wall blocks 500, arranged in a series side-by-side, with both being in an "upside down" orientation and, with the leftmost block 500 being in a "rear-facing" orientation and the rightmost block 500 being in a "front-facing" orientation, thereby to form part of an uncurved retaining wall such as wall 100 in FIG. 9. It will be noted that, despite the change in relative orientation, the two blocks 500 can laterally interlock. In particular, it can be seen that female-type lateral interface component 574*b* of the leftmost block 500 (part of the CFG) would receive male-type lateral interface component 576*b* of the rightmost block 500, and the female-type lateral interface component 574*b* of the rightmost block 500 (part of the CFG) would receive the male-type lateral interface component 576*b* of the leftmost block 500.

Figure 43:
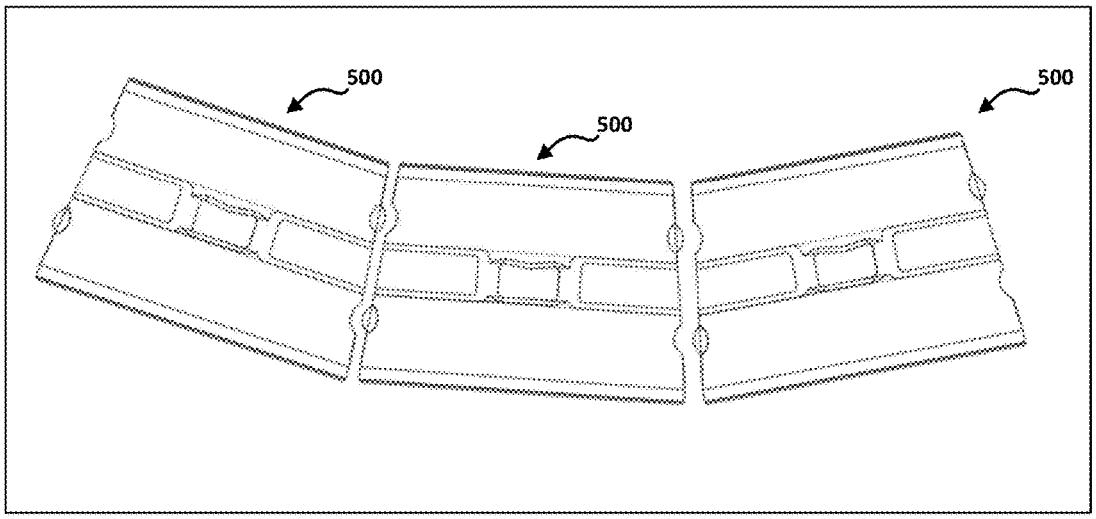
FIG. 43 is a top view of a number of segmental retaining wall blocks similar to that shown in FIG. 34, arranged in a series side-by-side but spaced from each other for illustrating the interactions of the continuous female elements and combination male/female elements with facing counterparts in a side wall of adjacent like blocks.

FIG. 43 is a top view of a series of segmental retaining wall blocks 500 similar to that shown in FIG. 34, arranged side-by-side but spaced from each other for illustrating the interactions of the continuous female groove CFG and combination male-female elements CMF with facing counterparts in a side wall of adjacent like blocks 500. In this configuration, all blocks 500 are right side up and can laterally interlock. For example, it can be seen that female-type lateral interface component 574*b* of the leftmost block 500 (part of the CFG) would receive male-type lateral interface component 576*b* of the middle block 500, and the female-type lateral interface component 574*b* of the middle block 500 (part of the CFG) would receive the male-type lateral interface component 576*b* of the leftmost block 500.

Figure 44:
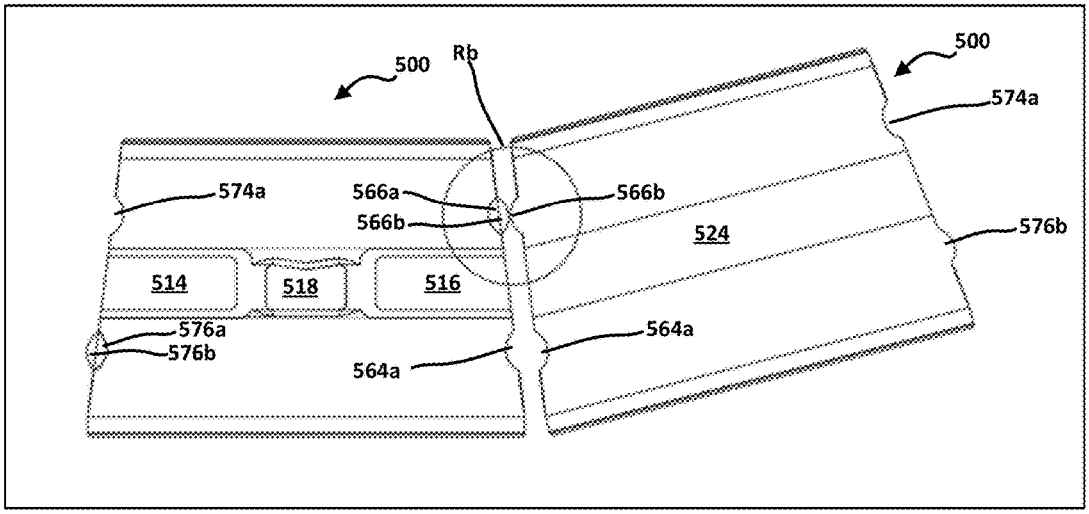
FIG. 44 is an enlarged top view of the interfacing of the sides of two of the adjacent segmental retaining blocks shown in FIGS. 34 and 43.

FIG. 44 is an enlarged top view of the interfacing of the sides of two adjacent segmental retaining blocks 500. In this configuration, the leftmost block 500 is right side up and forward facing, and the rightmost block is upside down and forward facing. Also, all blocks 500 can laterally interlock with an adjacent like block 500. For example, it can be seen that in the area encircled and labelled Rb, female-type lateral interface component 566*a* of the leftmost block 500 (part of the CMF) would receive male-type lateral interface component 566*b* of the rightmost block 500, and the female-type lateral interface component 566*a* of the rightmost block 500 (part of the CMF) would receive the male-type lateral interface component 566*b* of the leftmost block 500. The female-type lateral interface components 564*a* and 564*b* of the leftmost block 500 (part of the CFG) would face the female-type lateral interface components 574*a* and 574*b* of the rightmost block 500 (part of the CFG).

While embodiments have been described, alternatives are possible. For example, alternative configurations of lateral interlock interfaces may be provided. Such lateral interlock interfaces may take the general form shown in FIG. 45, which is an isometric simplified wireframe view of a segmental retaining wall block 600, according to an embodiment of the invention.

Figure 45:
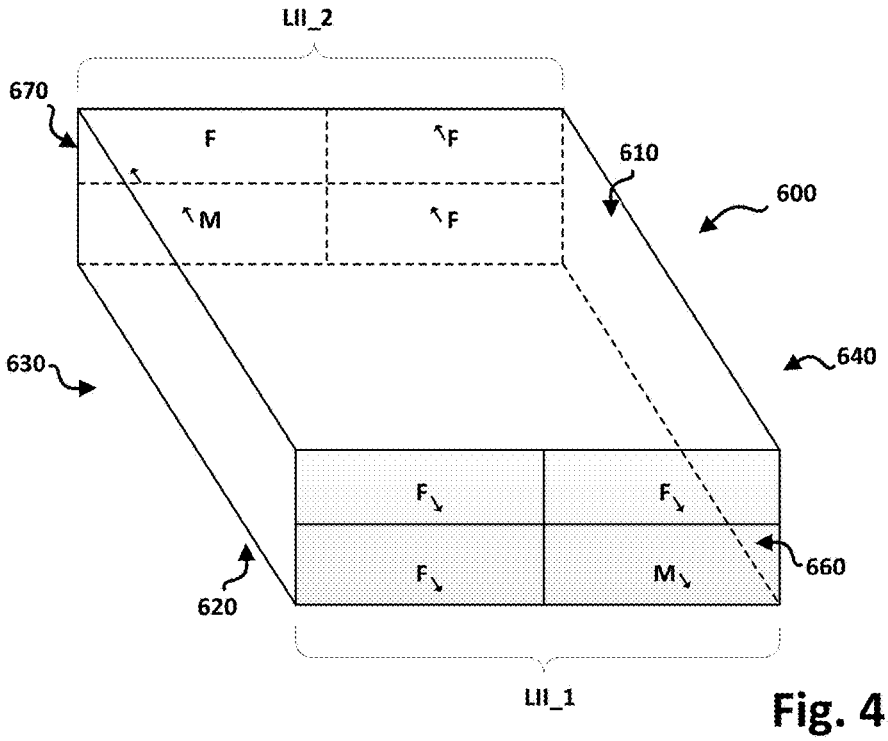
FIG. 45 is an isometric simplified wireframe view of a segmental retaining wall block, according to an embodiment of the invention.

As seen in FIG. 45, retaining wall block 600 also includes a block body. This is shown as being transparent for the purposes of explanation. However, similar to the embodiment of FIG. 19, the block body in this embodiment includes a top side 610 and a bottom side 620 opposite the top side 610, a front side 630 and a rear side 640 opposite the rear side 630, and a right side 660 and a left side 670 opposite the right side 660. Retaining wall block 600 also includes a lateral interlock system for enabling retaining wall block 600 to laterally interlock with another, like, block 600 for constructing a retaining wall with the blocks 600. As described above, lateral interlocking enables the blocks 600 to interlock with each other and other laterally-adjacent like blocks 600 to resist any individual block 600 being forced out of its place within the retaining wall by external forces such as the force of earth being retained by such a retaining wall.

In this embodiment, the lateral interlock system includes a first lateral interlock interface LII_1 that is integral with the right side 660 of the retaining wall block 600 (towards bottom right of page in FIG. 45) and a second lateral interlock interface LII_2 that is integral with the left side 670 of the retaining wall block 600 (towards top left of page in FIG. 45).

In this embodiment, each of the first and second lateral interlock interfaces LII_1, LII_2 includes a male-type lateral interface component M and three female-type lateral interface components F. Male-type lateral interface component M and female-type lateral interface components F are sized, shaped and positioned such that a male-type lateral interface component of a one block 600 is receivable within or otherwise receivable by the female-type lateral interface components of another like block 600 in a way that enables the blocks to laterally interlock while they are closely abutting. For example, while shown quite generally in FIG. 45 to illustrate the concept of cooperating male-type M and female-type F lateral interface components of respective lateral interlock interfaces LII_1, LII_2, typically each male-type lateral interface component M is an element (or elements) that protrudes outward from its respective right or left side, and each female-type lateral interface component F is an element (or elements) that recesses inwards from its respective right or left side and that is sized, shaped and positioned to receive a corresponding male-type lateral interface element (or elements) M of a laterally adjacent block 600.

Furthermore, each of the lateral interface components M, F is in vertical alignment with one of the other lateral interface components of the same lateral interlock interface LII_1 (LII_2) and is in horizontal alignment with still another of the lateral interface components of the same lateral interlock interface LII_1 (LII_2). For example, considering the first lateral interlock interface LII_1, the top left female-type lateral interface component F is in vertical alignment with one of the other lateral interface components (namely, bottom left female-type lateral interface component F) and is in horizontal alignment with still another of the lateral interface components (namely, top right female-type lateral interface component F). Similarly, the top right female-type lateral interface component F is in vertical alignment with one of the other lateral interface components (namely, bottom right male-type lateral interface component M) and is in horizontal alignment with still another of the lateral interface components (namely, as stated above, top left female-type lateral interface component F). Similarly, the bottom left female-type lateral interface component F is in vertical alignment with one of the other lateral interface components (namely, as stated above, top left female-type lateral interface component F) and is in horizontal alignment with still another of the lateral interface components (namely, bottom right male-type lateral interface component M). Similarly, the bottom right male-type lateral interface component M is in vertical alignment with one of the other lateral interface components (namely, as stated above, top right female-type lateral interface component F) and is in horizontal alignment with still another of the lateral interface components (namely, as stated above, bottom left female-type lateral interface component F).

It can be seen from FIG. 45 that the second lateral interlock interface LII_2 has a similar configuration to the first lateral interlock interface LII_1. In this embodiment, the first lateral interlock interface LII_1 and the second lateral interlock interface LII_2 are, when viewed in elevation, identical. What identical is intended to mean in the context of the lateral interlock interfaces LII_1, LII_2 is not necessarily indistinguishable, but that the M, F, F, F lateral interface components of the first lateral interlock interface LII_1 are positioned, shaped, and configured similarly enough to the M, F, F, F lateral interface components of the second lateral interlock interface LII_2 such that, were the first lateral interlock interface LII_1 able to be separated from retaining wall block 600 (such as if the retaining wall block 600 were split into right and left halves) and then presented to the second lateral interlock interface LII_2, these lateral interlock interfaces LII_1, LII_2 would be able to laterally interlock with each other while the respective sides with which they were associated were abutting. Therefore, two male-type lateral interface components M of facing lateral interlock interfaces each face and can be received by female-type lateral interface components F in the opposite block, rather than the male-type lateral interface components M of facing lateral interlock interfaces facing each other and thus preventing a lateral interlock due to their protruding outwards towards each other, neither of them being received by a female-type lateral interface component F. This is the case whether or not one of the two facing lateral interlock interfaces is upside-down/right-side up and/or front-facing/rear-facing with respect to the other. As such, the configuration of the left and right lateral interlock interfaces LII_1, LII_2 enable an installer of a retaining wall to construct a wall using several retaining wall blocks 600 while being able to choose whether each block is to be upside-down/right-side up and/or front-facing/rear-facing as will be described, while still providing lateral interlocking between blocks 600 for retaining wall structural integrity.

As shown in FIG. 45, the lateral interface components M, F, F, and F of the first lateral interlock interface LII_1 face in the direction of their respective arrows. Similarly, the lateral interface components M, F, F, and F of the second interlock interface LII_2 face in the directions of their respective arrows (namely, in the opposite direction to those of the first lateral interlock interface LII_1). As such, despite the two vertically-aligned female-type lateral interface components F being located towards the front side 630 of the retaining wall block 600 on the first lateral interlock interface LII_1 but located towards the rear side 640 of the retaining wall block 600 on the second lateral interlock interface LII_2 such that when viewed from the top side 610 they would be at opposite corners of the retaining wall block 600, were the first and second lateral interlock interfaces LII_1, LII_2 viewed in elevation from respective right or left sides 660, 670, the first and second lateral interlock interfaces LII_1, LII_2 themselves would appear identical.

The interfacing of two like blocks 600 in various configurations may be illustrated with reference to FIGS. 46 through 49.

Figure 46:
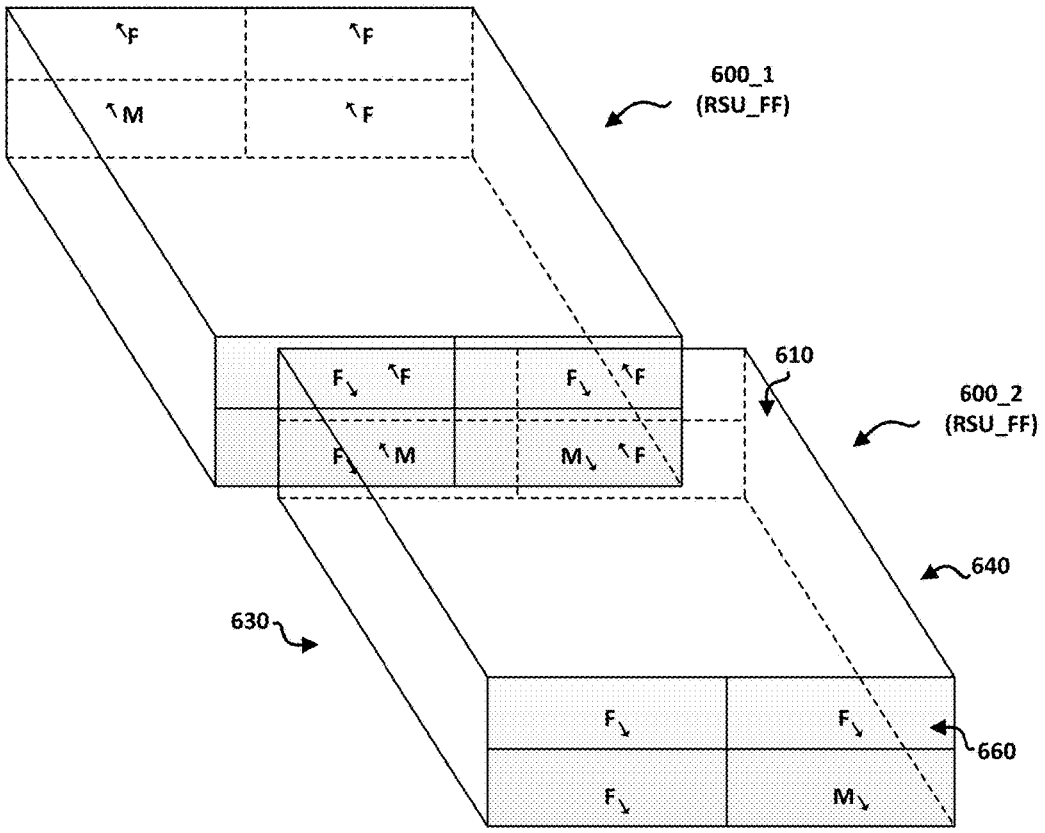
FIG. 46 is an isometric wireframe view of two of the segmental retaining wall blocks of FIG. 45 laterally interfacing with one another, with both of the blocks being right side up and forward facing.

For example, FIG. 46 is an isometric wireframe view of two of the segmental retaining wall blocks 600 of FIG. 45 (labelled 600_1 and 600_2) being brought together to laterally interface with one another, with both of the blocks 600_1 and 600_2 being right side up and forward facing (RSU_FF). It can be seen that no male-type lateral interface components M face each other. Rather, two female-type lateral interface components F on each of the facing lateral interlock interfaces LII_1, LII_2 face each other, and the one male-type lateral interface component M on each of the facing lateral interlock interfaces LII_1, LII_2 faces and can be received by a corresponding female-type lateral interface component F on the other.

Figure 47:
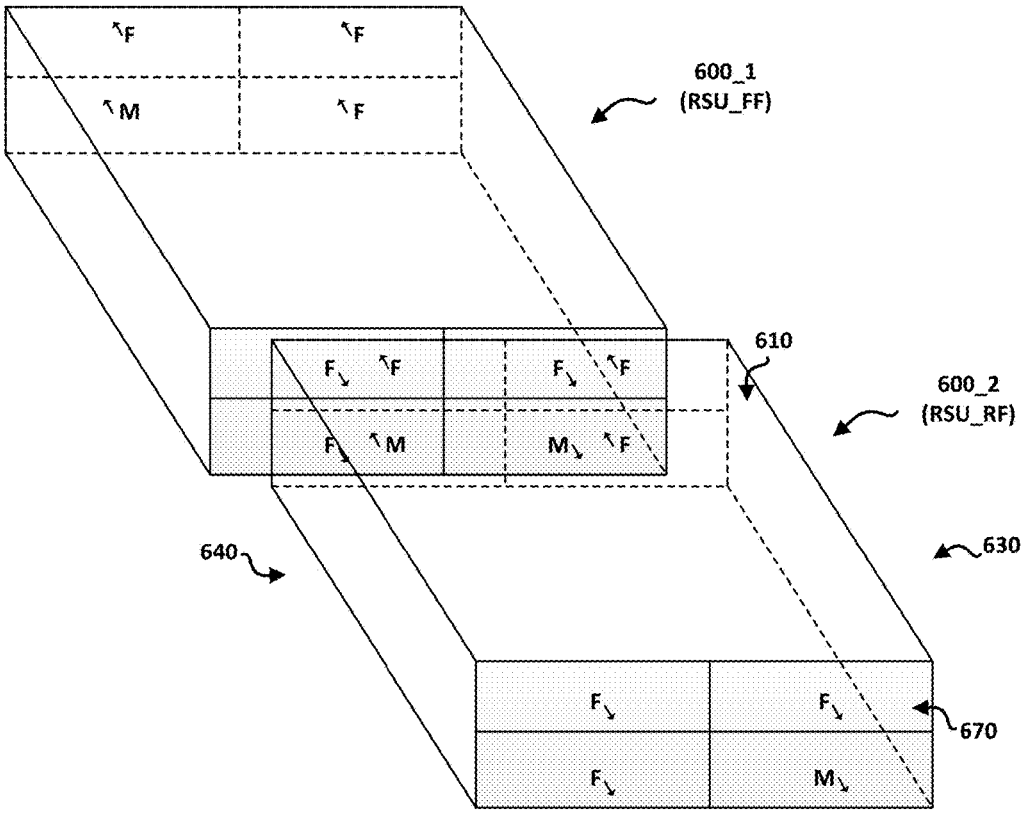
FIG. 47 is an isometric wireframe view of two of the segmental retaining wall blocks of FIG. 45 laterally interfacing with one another, with the second block being right side up and rearward facing.

FIG. 47 is an isometric wireframe view of two of the segmental retaining wall blocks 600_1 and 600_2 of FIG. 45 being brought together to laterally interface with one another, with the first block 600_1 being RSU_FF and the second block 600_2 being right side up and rearward facing (RSU_RF). Even though the block 600_2 has been rotated 180 degrees with respect to block 600_1 as compared with its orientation in FIG. 46, it can be seen that no male-type lateral interface components M face each other. Again, two female-type lateral interface components F on each of the facing lateral interlock interfaces face each other, and the one male-type lateral interface component M on each of the facing interlock interfaces faces and can be received by a corresponding female-type lateral interface component F on the other.

Figure 48:
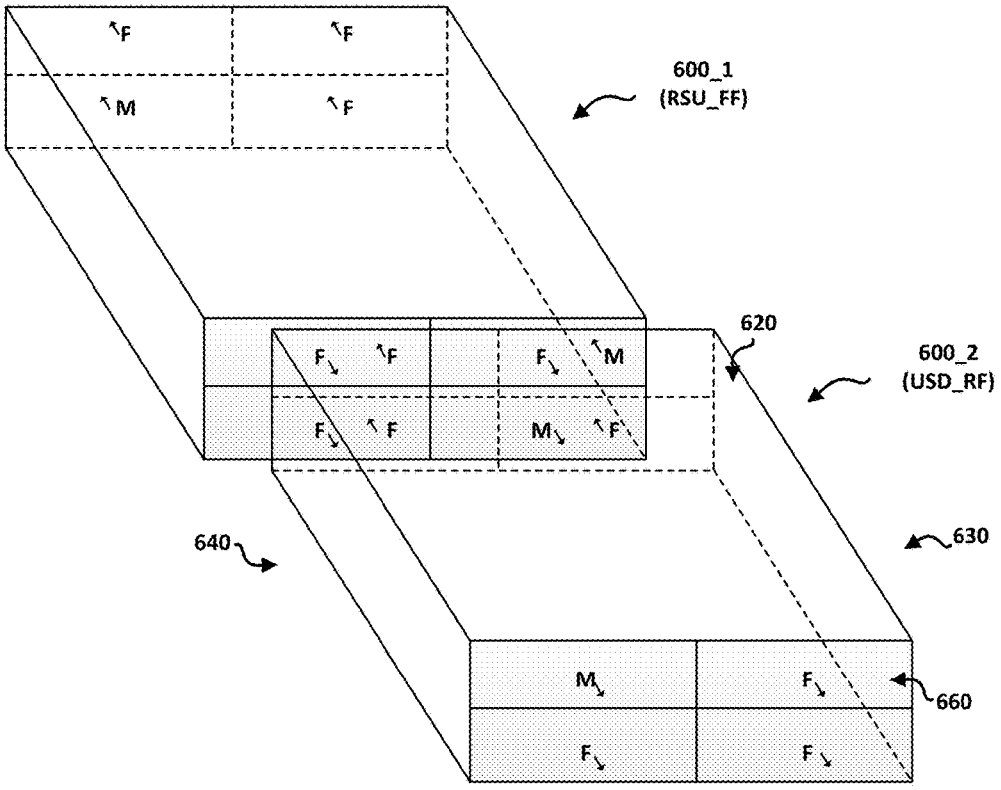
FIG. 48 is an isometric wireframe view of two of the segmental retaining wall blocks of FIG. 45 laterally interfacing with one another, with the second block being upside down and rearward facing.

FIG. 48 is an isometric wireframe view of two of the segmental retaining wall blocks 600_1 and 600_2 of FIG. 45 being brought together to laterally interface with one another, with the first block 600_1 being RSU_FF and the second block 600_2 being upside down and rearward facing (USD_RF). Even though the block 600_2 has been rotated 180 degrees in two different planes with respect to block 600_1 as compared with its orientation in FIG. 46, it can be seen that no male-type lateral interface components M face each other. Again, two female-type lateral interface components F on each of the facing lateral interlock interfaces face each other, and the one male-type lateral interface component M on each of the facing interlock interfaces faces and can be received by a corresponding female-type lateral interface component F on the other.

Figure 49:
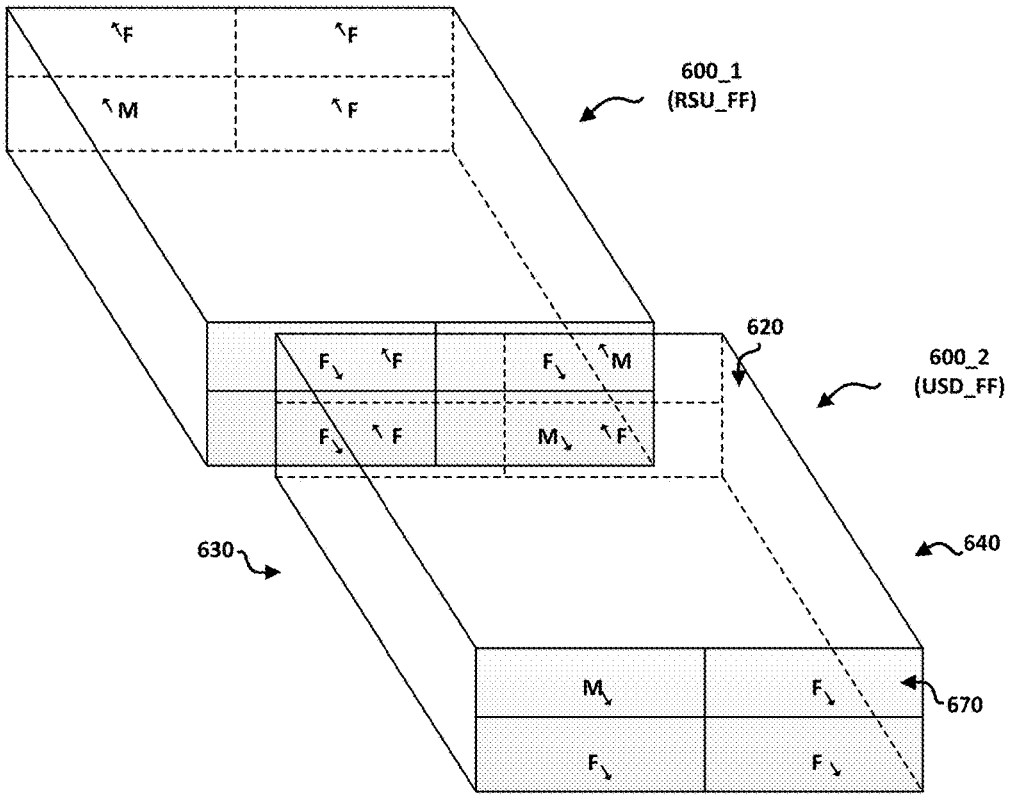
FIG. 49 is an isometric wireframe view of two of the segmental retaining wall blocks of FIG. 45 laterally interfacing with one another, with the second block being upside down and forward facing.

FIG. 49 is an isometric wireframe view of two of the segmental retaining wall blocks 600_1 and 600_2 of FIG. 45 being brought together to laterally interface with one another, with the first block 600_1 being RSU_FF and the second block 600_2 being upside down and forward facing (USD_FF). Even though the block 600_2 has been rotated 180 degrees with respect to block 600_1 as compared with its orientation in FIG. 46, it can be seen that no male-type lateral interface components M face each other. Again, two female-type lateral interface components F on each of the facing lateral interlock interfaces face each other, and the one male-type lateral interface component M on each of the facing interlock interfaces faces and can be received by a corresponding female-type lateral interface component F on the other.

Figure 50:
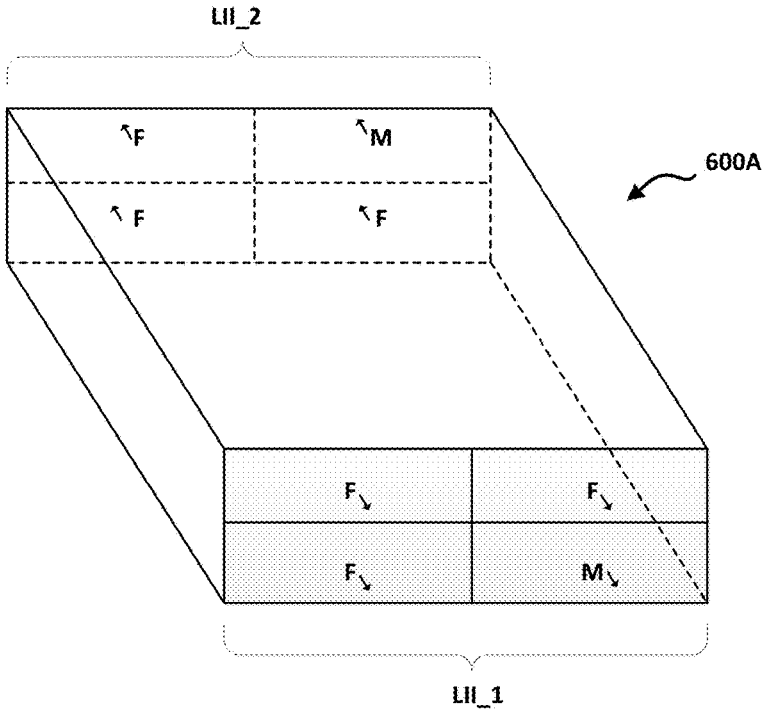
FIG. 50 is an isometric simplified wireframe view of an alternative segmental retaining wall block, according to an embodiment of the invention.

An isometric simplified wireframe view of another alternative segmental retaining wall block 600A, according to an embodiment of the invention, is shown in FIG. 50. Retaining wall block 600A is similar to retaining wall block 600, except that the first and second lateral interlock interfaces LII_1 and LII_2 of retaining wall block 600A are rotated with respect to each other by 180 degrees when viewed in elevation. That is, the male-type lateral interface components of LII_1 and LII_2 are both towards the rear face of the block, though the male-type lateral interface component of LII_1 is towards the bottom of the block 600A and the male-type lateral interface component of LII_2 is towards the top of the block 600A. As described above, such a block 600A may require additional consideration for molding where a mold box is to be lifted vertically off of formed blocks 600A.

Retaining wall block 600A includes a block body. This is shown in FIG. 50 as being transparent for the purposes of explanation. However, similar to the embodiment described above, the block body in this embodiment includes a top side and a bottom side opposite the top side, a front side and a rear side opposite the rear side, and a right side and a left side opposite the right side. Retaining wall block 600A also includes a lateral interlock system for enabling retaining wall block 600A to laterally interlock with another, like, block 600A for constructing a retaining wall with the blocks 600A. As described above, lateral interlocking enables the blocks 600A to interlock with each other and other laterally-adjacent like blocks 600A to resist any individual block 600A being forced out of its place within the retaining wall by external forces such as the force of earth being retained by such a retaining wall.

In this embodiment, the lateral interlock system includes a first lateral interlock interface LII_1 that is integral with the right side of the retaining wall block 600A (towards bottom right of page in FIG. 50) and a second lateral interlock interface LII_2 that is integral with the left side of the retaining wall block 600A (towards top left of page in FIG. 50).

In this embodiment, each of the first and second lateral interlock interfaces LII_1, LII_2 includes a male-type lateral interface component M and three female-type lateral interface components F. Male-type lateral interface component M and female-type lateral interface components F are sized, shaped and positioned such that a male-type lateral interface component of one block 600A is receivable within or otherwise receivable by the female-type lateral interface components of another like block 600A in a way that enables the blocks to laterally interlock while they are closely abutting. For example, while shown generally in FIG. 50 to illustrate the concept of cooperating male-type M and female-type F lateral interface components of respective lateral interlock interfaces LII_1, LII_2, typically each male-type lateral interface component M is an element (or elements) that protrudes outward from its respective right or left side, and each female-type lateral interface components F is an element (or elements) that recesses inwards from its respective right or left side and that is sized, shaped and positioned to receive a corresponding male-type lateral interface element (or elements) M of a laterally adjacent block 600A.

Furthermore, each of the lateral interface components M, F is in vertical alignment with one of the other lateral interface components of the same lateral interlock interface LII_1 (LII_2) and is in horizontal alignment with still another of the lateral interface components of the same lateral interlock interface LII_1 (LII_2). For example, considering the first lateral interlock interface LII_1, the top left female-type lateral interface component F is in vertical alignment with one of the other lateral interface components (namely, bottom left female-type lateral interface component F) and is in horizontal alignment with still another of the lateral interface components (namely, top right female-type lateral interface component F). Similarly, the top right female-type lateral interface component F is in vertical alignment with one of the other lateral interface components (namely, bottom right male-type lateral interface component M) and is in horizontal alignment with still another of the lateral interface components (namely, as stated above, top left female-type lateral interface component F). Similarly, the bottom left female-type lateral interface component F is in vertical alignment with one of the other lateral interface components (namely, as stated above, top left female-type lateral interface component F) and is in horizontal alignment with still another of the lateral interface components (namely, bottom right male-type lateral interface component M). Similarly, the bottom right male-type lateral interface component M is in vertical alignment with one of the other lateral interface components (namely, as stated above, top right female-type lateral interface component F) and is in horizontal alignment with still another of the lateral interface components (namely, as stated above, bottom left female-type lateral interface component F).

It can be seen from FIG. 50 that the second lateral interlock interface LII_2 has a similar configuration to the first lateral interlock interface LII_1. In this embodiment, the first lateral interlock interface LII_1 and the second lateral interlock interface LII_2 are, when viewed in elevation, identical except that they are rotated with respect to each other by 180 degrees. What identical is intended to mean in the context of the lateral interlock interfaces LII_1, LII_2 is not necessarily indistinguishable, but that the M, F, F, F lateral interface components of the first lateral interlock interface LII_1 are positioned, shaped, and configured similarly enough to the M, F, F, F lateral interface components of the second lateral interlock interface LII_2 such that, were the first lateral interlock interface LII_1 able to be separated from retaining wall block 600A (such as if the retaining wall block 600A were split into right and left halves) and then presented to the second lateral interlock interface LII_2, these lateral interlock interfaces LII_1, LII_2 would be able to laterally interlock with each other while the respective sides with which they were associated were abutting. Therefore, two male-type lateral interface components M of facing lateral interlock interfaces each face and can be received by female-type lateral interface components F in the opposite block, rather than the male-type lateral interface components M of facing lateral interlock interfaces facing each other and thus preventing a lateral interlock due to their protruding outwards towards each other, neither of them being received by a female-type lateral interface component F. This is the case whether or not one of the two facing lateral interlock interfaces is upside-down/right-side up and/or front-facing/rear-facing with respect to the other. As such, the configuration of the left and right lateral interlock interfaces LII_1, LII_2 enable an installer of a retaining wall to construct a wall using several retaining wall blocks 600A while being able to choose whether each block is to be upside-down/right-side up and/or front-facing/rear-facing as will be described, while still providing lateral interlocking between blocks 600A for retaining wall structural integrity.

As shown in FIG. 50, the lateral interface components M, F, F, and F of the first lateral interlock interface LII_1 face in the direction of their respective arrows. Similarly, the lateral interface components M, F, F, and F of the second interlock interface LII_2 face in the directions of their respective arrows (namely, in the opposite direction to those of the first lateral interlock interface LII_1).

The interfacing of two like blocks 600A in various configurations may be illustrated with reference to FIGS. 51 through 54.

Figure 51:
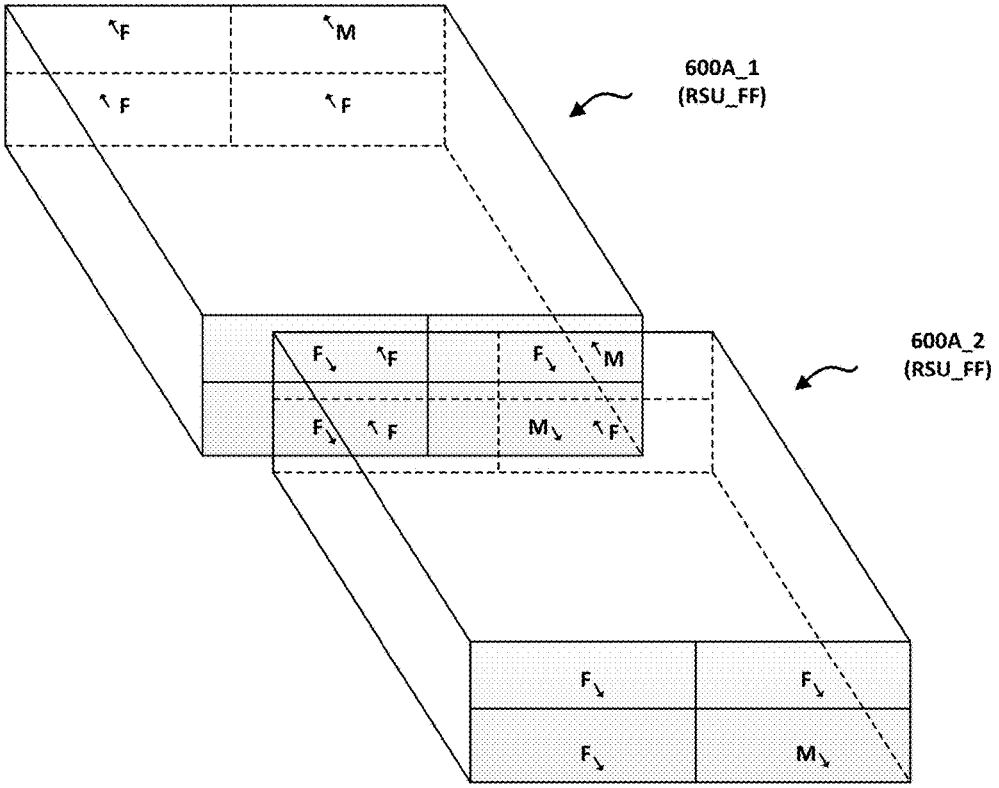
FIG. 51 is an isometric wireframe view of two of the segmental retaining wall blocks of FIG. 50 laterally interfacing with one another, with both of the blocks being right side up and forward facing.

For example, FIG. 51 is an isometric wireframe view of two of the segmental retaining wall blocks 600A of FIG. 50 (labelled 600A_1 and 600A_2) being brought together to laterally interface with one another, with both of the blocks 600A_1 and 600A_2 being right side up and forward facing (RSU_FF). It can be seen that no male-type lateral interface components M face each other. Rather, two female-type lateral interface components F on each of the facing lateral interlock interfaces LII_1, LII_2 face each other, and the one male-type lateral interface component M on each of the facing lateral interlock interfaces LII_1, LII_2 faces and can be received by a corresponding female-type lateral interface component F on the other.

Figure 52:
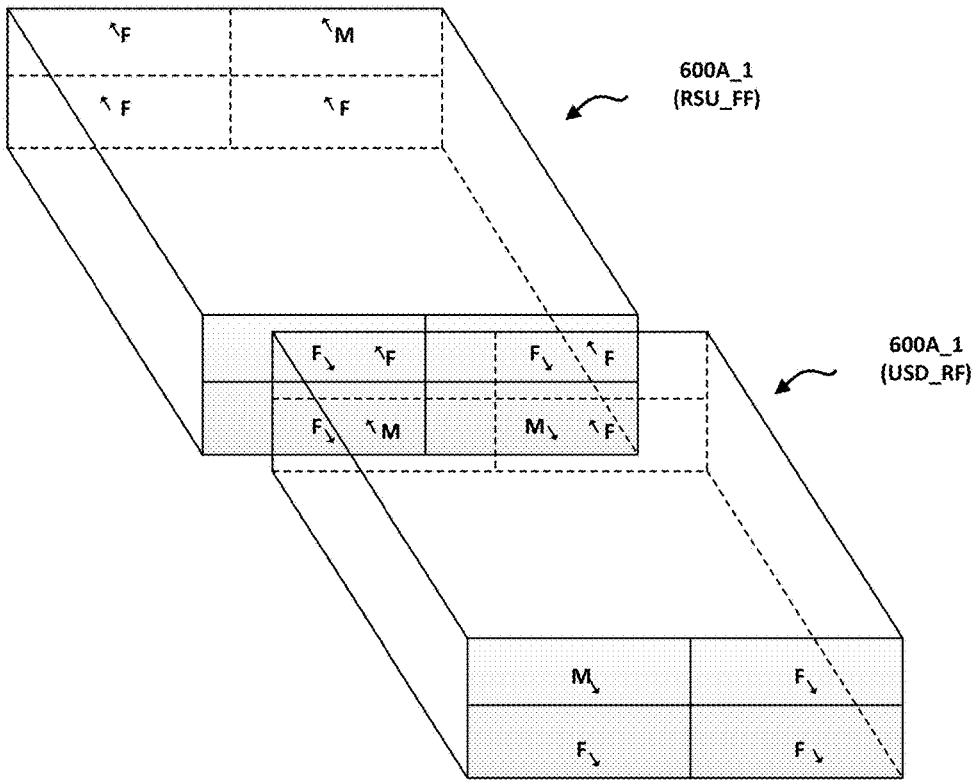
FIG. 52 is an isometric wireframe view of two of the segmental retaining wall blocks of FIG. 50 laterally interfacing with one another, with the second block being right side up and rearward facing.

FIG. 52 is an isometric wireframe view of two of the segmental retaining wall blocks 600A_1 and 600A_2 of FIG. 50 being brought together to laterally interface with one another, with the first block 600A_1 being RSU_FF and the second block 600A_2 being right side up and rearward facing (RSU_RF). Even though the block 600A_2 has been rotated 180 degrees with respect to block 600A_1 as compared with its orientation in FIG. 51, it can be seen that no male-type lateral interface components M face each other. Again, two female-type lateral interface components F on each of the facing lateral interlock interfaces face each other, and the one male-type lateral interface component M on each of the facing interlock interfaces faces and can be received by a corresponding female-type lateral interface component F on the other.

Figure 53:
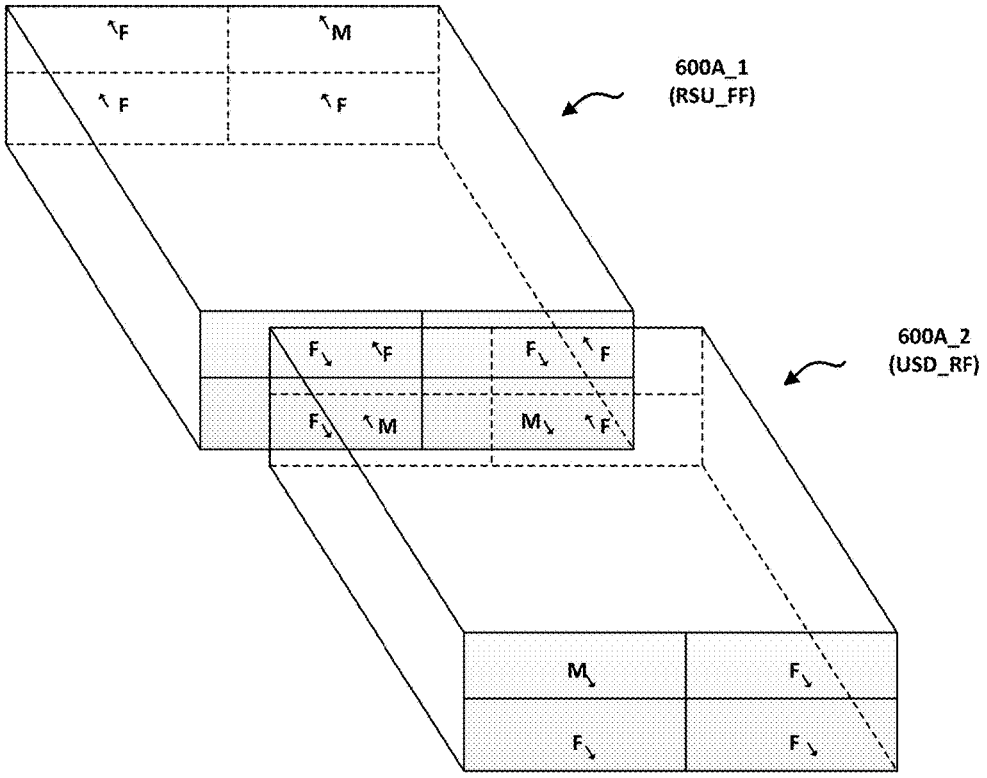
FIG. 53 is an isometric wireframe view of two of the segmental retaining wall blocks of FIG. 50 laterally interfacing with one another, with the second block being upside down and rearward facing.

FIG. 53 is an isometric wireframe view of two of the segmental retaining wall blocks 600A_1 and 600A_2 of FIG. 50 being brought together to laterally interface with one another, with the first block 600A_1 being RSU_FF and the second block 600A_2 being upside down and rearward facing (USD_RF). Even though the block 600A_2 has been rotated 180 degrees in two different planes with respect to block 600_1 as compared with its orientation in FIG. 51, it can be seen that no male-type lateral interface components M face each other. Again, two female-type lateral interface components F on each of the facing lateral interlock interfaces face each other, and the one male-type lateral interface component M on each of the facing interlock interfaces faces and can be received by a corresponding female-type lateral interface component F on the other.

Figure 54:
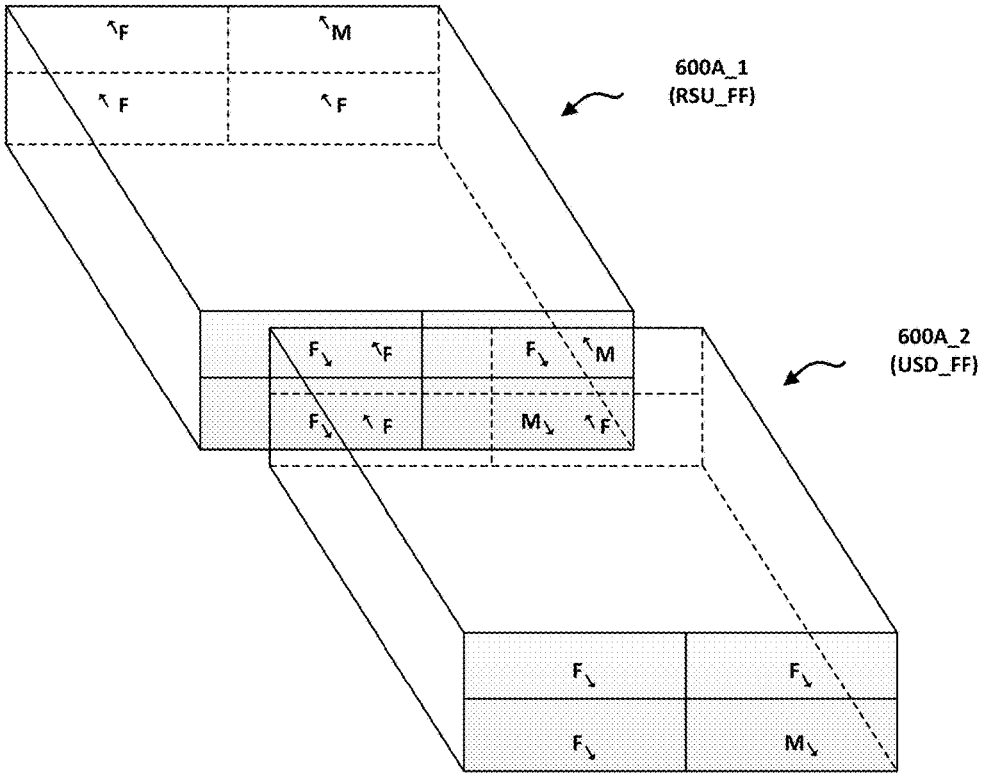
FIG. 54 is an isometric wireframe view of two of the segmental retaining wall blocks of FIG. 50 laterally interfacing with one another, with the second block being upside down and forward facing.

FIG. 54 is an isometric wireframe view of two of the segmental retaining wall blocks 600A_1 and 600A_2 of FIG. 50 being brought together to laterally interface with one another, with the first block 600A_1 being RSU_FF and the second block 600A_2 being upside down and forward facing (USD_FF). Even though the block 600A_2 has been rotated 180 degrees with respect to block 600A_1 as compared with its orientation in FIG. 51, it can be seen that no male-type lateral interface components M face each other. Again, two female-type lateral interface components F on each of the facing lateral interlock interfaces face each other, and the one male-type lateral interface component M on each of the facing interlock interfaces faces and can be received by a corresponding female-type lateral interface component F on the other.

Additional embodiments are possible.

For example, in alternative embodiments, the CFG could be formed in another shape that could receive correspondingly-shaped male portions of adjacent blocks, such as a rectangular key shape, dog-bone shape, etc.

Furthermore, blocks similar to block 500 could be formed not as a wedge, but as a non-wedged block, or as a rounded corner or other kind of transition block. Furthermore, blocks having a similar lateral interlock system and other aesthetic features to block 500 could be formed with a partial vertical interlock system that is absent protruding lugs 518 or grooves 514, 516 in its top face. Such a block could be useful as coping for finishing the top of a retaining wall or other structure being built.

Furthermore, while having a vertical interlock system has significant advantages as described herein, it will be understood that for certain applications, blocks similar to block 500 could be formed with a different kind of vertical interlock system than the sorts described herein, or without a vertical interlock system at all. For example, a block without a vertical interlock system but having a lateral interlock system such as those described herein may still be useful to enable a resultant wall to resist shear forces from, for example, lateral earth pressure despite not offering vertical interlocking between successive courses.

Furthermore, in embodiments, the front and rear faces of a block may be formed differently. For example, rather than the ledges for producing generally horizontal overhangs and shelves for highlights and shadows, one or both of the front and rear faces may alternatively be structured to present different "looks" that can be oriented to be upside down, right side up, front-facing or rear facing, as befits the aesthetic desires of the installer or the customer.

Furthermore, various dimensions of blocks may be employed in a given wall, provided that their respective lateral interlock systems and, if present then respective vertical interlock systems, are compatible for the purposes described herein. For example, a wide-face block presenting a wide ledge may be compatible with a narrow-face block presenting a narrow ledge, because their respective lateral interlock systems are identical or at least functional for interfacing in the manners described herein. Or, a double-height block could be made compatible with two standard-height blocks when the double-height block presented a lateral interlock interface that could interface with the lateral interlock interfaces of the two standard-height blocks beside it, regardless of the orientation of the double-height block or the individual orientations of the two single-height blocks.

Furthermore, the male-type and female-type lateral interface components described herein as having a combined conical and cylindrical configuration for ease of use, reduction of sharp edges, and ease of production, such lateral interface components may alternatively be provided with some other configuration. For example, a male-type lateral interface component may be provided as a rectangular block and female-type lateral interface components correspondingly sized and dimensioned to receive such a rectangular block. Other configurations of male-type and female-type lateral interface components are possible, such as male-type lateral interface components that are sized and shaped to be received properly within female-type lateral interface components, but do not necessarily mirror the shape and size of the female-type lateral interface components. For example, the male-type lateral interface component could be shorter than presented in block 500—thereby requiring slightly less dry cast material for its formation—while still being receivable and properly positionable within a female-type lateral interface component. Furthermore, while a CFG is provided in block 500, the two female-type lateral interface components constituting the CFG could alternatively be formed as segregated from each other in some way, provided they are each available for receiving a male-type lateral interface component of an adjacent block regardless of relative orientation.

What is claimed is:

1. A retaining wall block comprising:

a block body comprising:

a top side and a bottom side opposite the top side;

a front side and a rear side opposite the front side;

a right side and a left side opposite the right side;

a lateral interlock system comprising a first lateral interlock interface that is integral with the right side and a second lateral interlock interface that is integral with the left side, each of the first and second lateral interlock interfaces comprising:

a male-type lateral interface component and three female-type lateral interface components, each of the lateral interface components being in vertical alignment with only one of the other lateral interface components and in horizontal alignment with only still another of the lateral interface components, wherein the first lateral interlock interface and the second lateral interlock interface are, when viewed in elevation, identical, the retaining wall block further comprising:

a vertical interlock system comprising a first vertical interlock interface that is integral with the top side and in vertical alignment with a second vertical interlock interface that is integral with the bottom side.

2. The retaining wall block of claim 1, wherein each male-type lateral interface component extends upwards from the bottom side of the block body.

3. The retaining wall block of claim 2, wherein each male-type lateral interface component comprises a semi-cylindrical portion.

4. The retaining wall block of claim 1, wherein each male-type lateral interface component comprises a semi-cylindrical portion.

5. The retaining wall block of claim 1, wherein each male-type lateral interface component comprises a semi-conical portion integral with a semi-cylindrical portion.

6. The retaining wall block of claim 1, wherein two of the female-type lateral interface components that are in vertical alignment together form a continuous female-type channel that extends vertically through the block body from the top side to the bottom side.

7. The retaining wall block of claim 1, wherein the female-type lateral interface component and the male-type lateral interface component that are in vertical alignment together form a combination male-female interface element that extends vertically through the block body from the top side to the bottom side.

8. The retaining wall block of claim 7, wherein the female-type lateral interface component of the combination male-female interface element comprises a semi-cylindrical portion.

9. The retaining wall block of claim 8, wherein the female-type lateral interface component of the combination male-female interface element comprises a semi-conical portion integral with a semi-cylindrical portion.

10. The retaining wall block of claim 1, wherein each female-type lateral interface component comprises a semi-cylindrical portion.

11. The retaining wall block of claim 1, wherein each of the first vertical interlock interface and the second vertical interlock interface extends laterally through the block body from the right side to the left side.

12. The retaining wall block of claim 11, wherein:

the first vertical interlock interface comprises a male-type vertical interlock interface component flanked by two female-type vertical interlock interface components; and the second vertical interlock interface comprises a female-type vertical interlock interface component.

13. The retaining wall block of claim 1, wherein the block body is tapered to provide the front side and the rear side with different lateral widths.

14. The retaining wall block of claim 13, wherein an outer planar surface of each of the front side and the rear side extends downwards from the top side of the block body.

15. The retaining wall block of claim 1, wherein each of the front side and the rear side present:

an outer planar surface; and a recessed planar surface, wherein the outer and recessed planar surfaces presented by the front side have different vertical heights than the outer and recessed planar surfaces, respectively, presented by the rear side.

16. The retaining wall block of claim 1, wherein the first lateral interlock interface and the second lateral interlock interface are, when viewed in elevation, identical and offset from one another by 180 degrees.

* * * * *